US008133648B2

(12) United States Patent
Maehata et al.

(10) Patent No.: US 8,133,648 B2
(45) Date of Patent: Mar. 13, 2012

(54) ELECTROSTATIC IMAGE DEVELOPING TONER, PRODUCTION METHOD THEREOF, ELECTROSTATIC IMAGE DEVELOPER, IMAGE FORMING METHOD AND IMAGE FORMING APPARATUS

(75) Inventors: Hideo Maehata, Kanagawa (JP); Hirotaka Matsuoka, Kanagawa (JP); Yasuo Matsumura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 810 days.

(21) Appl. No.: 12/208,094

(22) Filed: Sep. 10, 2008

(65) Prior Publication Data

US 2009/0162762 A1 Jun. 25, 2009

(30) Foreign Application Priority Data

Dec. 19, 2007 (JP) ..... 2007-326885

(51) Int. Cl.
*G03G 9/087* (2006.01)

(52) U.S. Cl. ..... 430/109.4; 430/137.14; 430/123.5

(58) Field of Classification Search ..... 430/109.4, 430/109.3, 110.3, 137.14, 123.5
See application file for complete search history.

(56) References Cited

U.S. PATENT DOCUMENTS

| | | | | |
|---|---|---|---|---|
| 4,588,668 | A * | 5/1986 | Yasuda et al. | 430/109.4 |
| 5,723,246 | A * | 3/1998 | Aoki et al. | 430/109.4 |
| 6,383,705 | B2 * | 5/2002 | Aoki et al. | 430/109.4 |
| 7,723,002 | B2 * | 5/2010 | Shimokusa et al. | 430/109.4 |
| 2003/0096184 | A1 * | 5/2003 | Kawaji et al. | 430/109.4 |
| 2003/0118929 | A1 * | 6/2003 | Shirai et al. | 430/109.4 |
| 2004/0132920 | A1 * | 7/2004 | Matsumura et al. | 430/109.4 |
| 2006/0110672 | A1 * | 5/2006 | Sato et al. | 430/109.4 |
| 2006/0127785 | A1 * | 6/2006 | Sato et al. | 430/109.4 |
| 2006/0292476 | A1 * | 12/2006 | Maehata et al. | 430/109.4 |
| 2008/0044753 | A1 * | 2/2008 | Hirota | 430/109.1 |
| 2008/0182194 | A1 * | 7/2008 | Shirai et al. | 430/109.4 |

FOREIGN PATENT DOCUMENTS

| | | | |
|---|---|---|---|
| JP | A-7-98518 | | 4/1995 |
| JP | A-2002-72562 | | 3/2002 |
| JP | 2003270853 | A * | 9/2003 |
| JP | 2006350035 | A * | 12/2006 |
| JP | 2008015271 | A * | 1/2008 |

OTHER PUBLICATIONS

English language machine translation of JP 2003-270853 (Sep. 2003).*
English language machine translation of JP 2006-350035 (Dec. 2006).*
English language machine translation of JP 2008-015271 (Jan. 2008).*
Aoki, Takayoshi. "Chemical Toner Technology and The Future", IS&T's NIP19, pp. 2-5 (2003).*
T. Loontjens et al.; "The Action of Chain Extenders in Nylon-6, PET, and Model Compounds;" Sep. 20, 1996; pp. 1813-1819.

* cited by examiner

*Primary Examiner* — Christopher Rodee
(74) *Attorney, Agent, or Firm* — Oliff & Berridge, PLC

(57) ABSTRACT

An electrostatic image developing toner includes a binder resin that includes a polyester carbonate resin or a polyester amide resin, the polyester carbonate resin or the polyester amide resin containing a dodecenylsuccinic acid unit in an mount from about 0.5 mol % to about 30 mol % as a monomer unit; and a colorant.

16 Claims, No Drawings

ELECTROSTATIC IMAGE DEVELOPING TONER, PRODUCTION METHOD THEREOF, ELECTROSTATIC IMAGE DEVELOPER, IMAGE FORMING METHOD AND IMAGE FORMING APPARATUS

CROSS-REFERENCE TO RELATED APPLICATIONS

This application is based on and claims priority under 35 USC 119 from Japanese Patent Application No. 2007-326885 filed on Dec. 19, 2007.

BACKGROUND

1. Technical Field

The present invention relates to an electrostatic image developing toner, a production method thereof, an electrostatic image developer, an image forming method and an image forming apparatus.

2. Related Art

The toner production technique in the electro-photographic process has made a changeover, in view of the toner characteristics, from the kneading/grinding method to a so-called chemical process, that is, a production method of a toner in an aqueous medium, such as emulsion polymerization aggregation method and suspension polymerization method. Furthermore, in the recent effort of the society to reduce the environmental load, studies on a toner fixable with lower energy are also proceeding for the purpose of reducing the electrical energy consumed in an electrophotographic machine. By virtue of such a toner, in the electrophotographic process, both downsizing of the machine and high productivity can be satisfied and development of a high-speed digital printing machine using such a low-energy fixing toner is aggressively made at present.

SUMMARY

According to an aspect of the invention, there is provided an electrostatic image developing toner including a binder resin that includes a polyester carbonate resin or a polyester amide resin, the polyester carbonate resin or the polyester amide resin containing a dodecenylsuccinic acid unit in an mount from about 0.5 mol % to about 30 mol % as a monomer unit; and a colorant.

DETAILED DESCRIPTION

The present invention is described in detail below.

(Electrostatic Image Developing Toner)

The electrostatic image developing toner (hereinafter sometimes simply referred to as a "toner") of the present invention contains a binder resin and a colorant, wherein the binder resin contains a polyester carbonate resin (hereinafter sometimes referred to as a "polyester carbonate resin") or a polyester amide resin and the polyester carbonate resin or polyester amide resin has, as a monomer unit, from about 0.5 mol % to about 30 mol % of a dodecenylsuccinic acid unit.

Conventionally, at the production of a chemical process toner using a polyester resin, in the case of a chemical process toner produced in a high-temperature aqueous medium containing an acid or an alkali, deterioration of the resin due to decomposition of the ester bond during production is a large problem.

This resin deterioration induces toner surface roughening (i.e., worsening of flowability) and widening of the electric charge distribution due to a deteriorated substance, and these causes scattering of the toner in an apparatus at the image formation and in turn, reduction in the image quality.

In the electrostatic image developing toner of the present invention, a polyester carbonate resin or a polyester amide resin is used as the binder resin, whereby resistance to hydrolysis which may occur with aging or in a high-temperature aqueous medium containing an acid or an alkali at the toner production is enhanced, toner scattering in an apparatus at the image formation is improved, the electric charge distribution is sharpened, and the image quality characteristics are bettered.

Also, in the electrostatic image developing toner of the present invention, a polyester carbonate resin or polyester amide resin having, as a monomer unit, from about 0.5 mol % to about 30 mol % of a dodecenylsuccinic acid unit is used, whereby in addition to the hydrolysis resistance of the carbonate or amide bond, the hydrolysis resistance can be more enhanced by the steric effect of the dodecenyl branch.

Furthermore, the long-chain decenyl branch of the dodecenylsuccinic acid unit causes intertwining between their molecules, so that the resin toughness which practically becomes a problem in the carbonate or amide bond resin can be greatly improved. Hydrolysis of the resin, which often occurs as a problem when producing a chemical process toner by using a polyester resin, results not only in the reduction of resin strength but also in the adverse effect on the electric charge stability of the toner due to the produced hydrolysate.

The electrostatic image developing toner of the present invention contains a polyester carbonate resin or a polyester amide resin, and the polyester carbonate resin or polyester amide resin has, as a monomer unit, from about 0.5 mol % to about 30 mol % of a dodecenylsuccinic acid unit.

In the present invention, the "polyester carbonate resin" indicates a polymer having an ester bond and a carbonate bond (carbonic ester bond).

In the present invention, the "polyester amide resin" indicates a polymer having an ester bond and an amide bond.

The electrostatic image developing toner of the present invention contains at least a polyester carbonate resin having, as a monomer unit, from about 0.5 mol % to about 30 mol % of a dodecenylsuccinic acid unit or a polyester amide resin having, as a monomer unit, from about 0.5 mol % to about 30 mol % of a dodecenylsuccinic acid unit.

The polyester carbonate resin or polyester amide resin has, as a monomer unit, a dodecenylsuccinic acid unit in a range of about 0.5 mol % to about 30 mol %, preferably in a range of about 3 mol % to about 15 mol %, more preferably in a range of about 5 mol % to about 10 mol %. If the dodecenylsuccinic acid is used in excess of 30 mol %, the glass transition temperature of the toner resin can be hardly adjusted to a practically satisfactory region and there may arise a problem that thermal stability of the toner during storage and archivability of the document after fixing are impaired, whereas if it is used in less than 0.5 mol %, the resin cannot be imparted with satisfactory hydrolyzability and toughness.

In the present invention, the monomer unit of the polyester carbonate resin or polyester amide resin indicates a constituent unit defined between a carbonyl group in the ester bond and an oxygen atom bonded by a single bond to a carbonyl group, between a carbonyl group in the carbonic ester bond and an oxygen atom bonded by a single bonded to a carbonyl group, or between a carbonyl group in the amide bond and a nitrogen atom bonded by a single bond to a carbonyl group. The carbonyl group moiety in the carbonic ester bond is not included in the monomer unit.

The dodecenylsuccinic acid unit for use in the present invention indicates a constituent unit represented by the following formula (1):

(1)

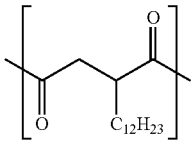

(wherein $C_{12}H_{23}$ represents a linear or branched dodecenyl group, and one double bond present in the dodecenyl group may be located at an arbitrary position).

As for the dodecenyl group ($C_{12}H_{23}$) in the constituent unit represented by formula (1), an arbitrary dodecenyl group can be independently selected for respective constituent units in the polyester carbonate resin or polyester amide resin.

Incidentally, the constituent unit represented by formula (1) of course includes the constituent units represented by the following formulae (1-1) and (1-2). Also, in the polyester carbonate resin or polyester amide resin, the constituent units represented by the following formulae (1-1) and/or (1-2) can be present in an arbitrary ratio and in an arbitrary arrangement, as the constituent unit represented by formula (1).

(1-1)

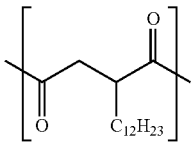

(1-2)

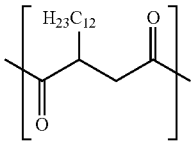

(wherein $C_{12}H_{23}$ represents a linear or branched dodecenyl group, and one double bond present in the dodecenyl group may be located at an arbitrary position).

Preferred examples of the polycondensable monomer for forming the dodecenylsuccinic acid unit include a dodecenylsuccinic anhydride, a dodecenylsuccinic acid, an alkyl ester of dodecenylsuccinic acid, and a salt of dodecenylsuccinic acid, with a dodecenylsuccinic anhydride being more preferred. The alkyl ester is preferably an alkyl ester having a carbon number of 1 to 8.

One species of a polycondensable monomer for forming the dodecenylsuccinic acid unit may be used alone, or two or more species may be used in combination.

The polyester carbonate resin which can be used in the present invention is preferably a resin having a structure where polyester chains are linked by a carbonic ester bond.

The production method of the polyester carbonate resin is not particularly limited, but preferred examples thereof include the following method.

That is, the production method of the polyester carbonate resin is preferably a production method including a step of producing a polyester resin having a hydroxy group, and a step of reacting the polyester resin having a hydroxy group with a compound represented by the following formula (2) to obtain a polyester carbonate resin.

(2)

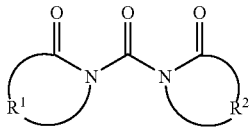

(wherein $R^1$ and $R^2$ each independently represents a divalent linking group).

The divalent linking group in $R^1$ and $R^2$ of formula (2) is preferably a hydrocarbon group or a hydrocarbon group with a part of the carbon atom being replaced by an oxygen atom, more preferably a hydrocarbon group.

Also, $R^1$ and $R^2$ are preferably the same group allowing the compound represented by formula (2) to be in line symmetry with respect to the center carbonyl group in formula (2).

In formula (2), the ring composed of $R^1$, carbon atom of imide bond and nitrogen atom, and the ring composed of $R^2$, carbon atom of imide bond and nitrogen atom each is preferably a 4-to 10-membered ring, more preferably a 4- to 8-membered ring, still more preferably a 7-membered ring.

Above all, the compound represented by formula (2) is preferably carbonylbis(1-caprolactam).

The reaction between the polyester resin having a hydroxy group and the compound represented by formula (2) proceeds as follows to form a carbonic ester bond.

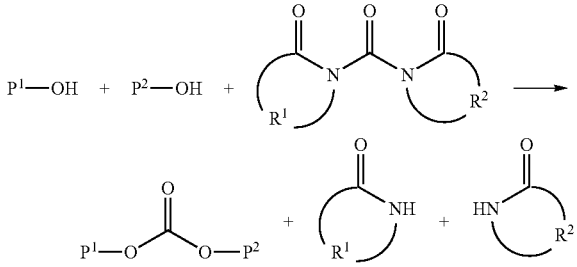

(wherein $P^1$—OH and $P^2$—OH each independently represents a polyester resin having a hydroxy group, and $R^1$ and $R^2$ each independently represents a divalent linking group).

At the reaction with a polyester resin having a hydroxy group, one species of the compound represented by formula (2) may be used alone, or two or more species thereof may be used in combination.

Also, one species of the polyester resin having a hydroxy group may be used alone, or two or more species thereof may be used in combination.

The weight average molecular weight of the polyester having a hydroxy group is preferably from 1,000 to 10,000, more preferably from 2,000 to 8,000.

The weight average molecular weight of the polyester carbonate resin which can be used in the present invention is preferably from about 3,000 to about 60,000, more preferably from about 5,000 to about 40,000.

When the weight average molecular weight is 3,000 or more, suitable cohesive force as a binder resin can be obtained and good performance in terms of offset property is advantageously obtained. Also, when the weight average molecular weight is 60,000 or less, good performance in terms of offset property and a suitable minimum fixing temperature can be obtained and this is preferred.

Also, the polyester carbonate resin may be partially branched or crosslinked, for example, by selecting the valence number of the carboxylic acid or alcohol of the polycondensable monomer.

The polyester amide resin which can be used in the present invention is preferably a resin containing a constituent unit represented by the following formula (A), more preferably a resin containing a constituent unit represented by the following formula (B), still more preferably a resin having a structure where polyester chains are linked by a constituent unit represented by the following formula (B).

(A)

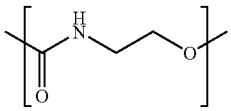

(B)

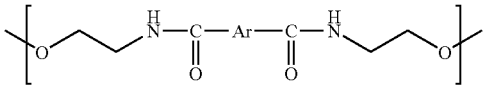

(wherein in formula (B), Ar represents a divalent aromatic group).

Incidentally, polyester chains are linked by forming an ester bond (—COO—) containing the oxygen atom at the terminal in formula (B).

In formula (B), Ar is a divalent aromatic group, preferably a group formed by removing two hydrogen atoms from a hydrocarbon aromatic group, more preferably a phenylene group, still more preferably a 1,3-phenylene group or a 1,4-phenylene group.

The production method of the polyester amide resin is not particularly limited, but preferred examples thereof include the following method.

That is, the production method of the polyester amide resin is preferably a production method including a step of producing a polyester resin having a carboxyl group, and a step of reacting the polyester resin having a carboxyl group with a compound represented by the following formula (3) to obtain a polyester amide resin.

(3)

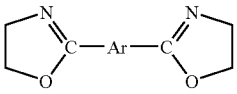

(wherein Ar represents a divalent aromatic group).

In formula (3), Ar is a divalent aromatic group, preferably a group formed by removing two hydrogen atoms from a hydrocarbon aromatic group, more preferably a phenylene group, still more preferably a 1,3-phenylene group or a 1,4-phenylene group.

At the reaction with a polyester resin having a carboxyl group, one species of the compound represented by formula (3) may be used alone, or two or more species thereof may be used in combination.

Also, one species of the polyester resin having a carboxyl group may be used alone, or two or more species thereof may be used in combination.

The reaction between the polyester resin having a carboxyl group and the compound represented by formula (3) proceeds as follows to form a carbonic ester bond.

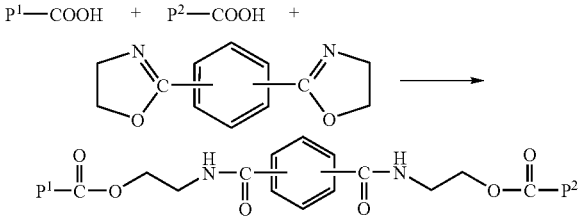

(wherein $P^1$—COOH and $P^2$—COOH each independently represents a polyester resin having a carboxyl group).

The weight average molecular weight of the polyester having a carboxyl group is preferably from 1,000 to 10,000, more preferably from 2,000 to 8,000.

The weight average molecular weight of the polyester amide resin which can be used in the present invention is preferably from about 3,000 to about 60,000, more preferably from about 5,000 to about 40,000.

When the weight average molecular weight is 3,000 or more, suitable cohesive force as a binder resin can be obtained and good performance in terms of offset property is advantageously obtained. Also, when the weight average molecular weight is 60,000 or less, good performance in terms of offset property and a suitable minimum fixing temperature can be obtained and this is preferred.

Also, the polyester amide resin may be partially branched or crosslinked, for example, by selecting the valence number of the carboxylic acid or alcohol of the polycondensable monomer.

As for the polycondensable monomer which can be used in the synthesis of the polyester carbonate resin or polyester amide resin, a polycarboxylic acid, a polyhydric alcohol, a hydroxycarboxylic acid and the like, described below, can be suitably used, other than the polycondensable monomer for forming the dodecenylsuccinic acid unit, the compound represented by formula (2) and the compound represented by formula (3).

The polyester carbonate resin or polyester amide resin is preferably synthesized by polycondensing only a divalent polycondensable monomer.

In the present invention, the polyvalent carboxylic acid includes an aliphatic, alicyclic or aromatic polyvalent carboxylic acid, an alkyl ester thereof, a salt thereof, and an acid anhydride or acid halide thereof, and the polyhydric alcohol includes a polyhydric alcohol, an ester compound thereof and the like. The same applies to a hydroxycarboxylic acid.

The polyvalent carboxylic acid which can be used in the present invention is a compound containing two or more carboxyl groups in one molecule.

Out of these compounds, the dicarboxylic acid is a compound containing two carboxyl groups in one molecule, and examples thereof include oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecenylsuccinic acid, dodecanedicarboxylic acid, fumaric acid, citraconic acid, diglycolic acid, cyclohexanedicarboxylic acid, cyclohexane-3,5-diene-1,2-dicarboxylic acid, hexahydroterephthalic acid, malonic acid, pimelic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid and dodecenylsuccinic acid.

Examples of the polyvalent carboxylic acid other than the dicarboxylic acid include trimellitic acid, pyromellitic acid, naphthalenetricarboxylic acid, naphthalenetetracarboxylic acid, pyrenetricarboxylic acid and pyrenetetracarboxylic acid.

One species of these polyvalent carboxylic acids may be used alone, or two or more species thereof may be used in combination.

The polyhydric alcohol (polyol) is a compound containing two or more hydroxyl groups in one molecule.

Out of these compounds, the divalent polyol (diol) is a compound having two hydroxyl groups in one molecule, and examples thereof include ethylene glycol, propylene glycol, butanediol, diethylene glycol, hexanediol, cyclohexanediol, octanediol, decanediol, dodecanediol, ethylene oxide adduct of bisphenol A, propylene oxide adduct of bisphenol A, bisphenoxy alcohol fluorene (bisphenoxy ethanol fluorene).

Examples of the polyol other than the divalent polyol include glycerin, pentaerythritol, hexamethylolmelamine, hexaethylolmelamine, tetramethylolbenzoguanamine and tetraethylolbenzoguanamine.

One species of these polyhydric alcohols (polyols) may be used alone, or two or more species thereof may be used in combination.

Examples of the hydroxycarboxylic acid include hydroxyheptanoic acid, hydroxyoctanoic acid, hydroxydecanoic acid, hydroxyundecanoic acid, 2,2-dimethylolbutanoic acid, malic acid, tartaric acid, mucic acid and citric acid.

The polyester structure can be arbitrarily controlled to a noncrystalline resin structure, a crystalline resin structure or a mixed structure thereof by the combination of these polycondensable monomers. In the present invention, one species or two or more species of polyester resins may be used as the polyester resin, and the combination of polyester structures such as noncrystalline and crystalline may be arbitrarily selected.

The polyester carbonate resin or polyester amide resin which can be used in the present invention is preferably a noncrystalline resin.

Examples of the polyhydric carboxylic acid used for obtaining crystalline resin include oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and an acid anhydride or acid chloride thereof.

Examples of the polyhydric alcohol used for obtaining a crystalline resin include ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexanedimethanol, dipropylene glycol, polyethylene glycol and polypropylene glycol.

As for the polyvalent carboxylic acid used for obtaining a noncrystalline resin, out of the above-described polyvalent carboxylic acids, examples of the dicarboxylic acid include phthalic acid, isophthalic acid, terephthalic acid, tetrachlorophthalic acid, chlorophthalic acid, nitrophthalic acid, malonic acid, mesaconic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, cyclohexenedicarboxylic acid, norbornene-2,3-dicarboxylic acid, adamantanedicarboxylic acid and adamantanediacetic acid. Examples of the polyvalent carboxylic acid other than the dicarboxylic acid include trimellitic acid, pyromellitic acid, naphthalenetricarboxylic acid, naphthalenetetracarboxylic acid, pyrenetricarboxylic acid and pyrenetetracarboxylic acid. Compounds obtained by deriving an acid anhydride, an acid chloride, an ester or the like from the carboxylic group of these carboxylic acids may also be used.

Among these, terephthalic acid or a lower ester thereof, fumaric acid, diphenylacetic acid and cyclohexanedicarboxylic acid are preferred, and terephthalic acid or lower ester thereof and fumaric acid are more preferred. The lower ester indicates an ester with an aliphatic alcohol having a carbon number of 1 to 8.

Also, at least dimethyl terephthalate is preferably used as the polyvalent carboxylic acid, and it is more preferred to use dimethyl terephthalate in an amount of 20 mol % or more based on the total molar amount of the polycondensable monomers.

As for the polyhydric alcohol used for obtaining a noncrystalline resin, out of the above-described polyols, polytetramethylene glycol, bisphenol A, bisphenol Z, bisphenol S, biphenol, naphthalenediol, adamantanediol, adamantanedimethanol, hydrogenated bisphenol A, cyclohexanedimethanol, bisphenoxy alcohol fluorene, and an alkylene oxide adduct thereof are preferred.

Among these, an alkylene oxide adduct of bisphenols is more preferably used for the polyester carbonate resin or polyester amide resin, and an alkylene oxide adduct of bisphenol A is still more preferred.

Also, it is particularly preferred to use an ethylene oxide adduct of bisphenol A and a propylene oxide adduct of bisphenol A in combination in the polyester carbonate resin or polyester amide resin.

The addition molar number of the alkylene oxide in the alkylene oxide adduct is not particularly limited, but a compound where an alkylene oxide is in 1 mol or is 1 mol-added per mol of the hydroxy group is preferred, and a compound where an alkylene oxide is 1 mol-added is more preferred.

For producing one species of a polycondensed resin, one species of the polyvalent carboxylic acid and one species of the polyhydric alcohol each may be used alone, one species of one member and two or more species of another member may be used, or two species of each member may be used. In the case of using a hydroxycarboxylic acid, for producing one species of a polycondensed resin, one species may be used alone, two or more species may be used, or the hydroxycarboxylic acid may be used in combination with a polyvalent carboxylic acid or a polyhydric alcohol.

In the case where the polyester carbonate resin or polyester amide resin for use in the present invention is crystalline, the crystal melting temperature Tm is preferably from about 50° C. to about 120° C., more preferably from about 55° C. to about 90° C. When Tm is 50° C. or more, the cohesive force of the crystalline resin in the high-temperature region is in an appropriate range and at the fixing, good releasability and no generation of offset can be obtained. Also, when Tm is 120° C. or less, sufficient melting and a suitable minimum fixing temperature are obtained.

On the other hand, in the case where the polyester carbonate resin or polyester amide resin for use in the present invention is noncrystalline, the glass transition temperature Tg is preferably from about 40° C. to about 80° C., more preferably from about 50° C. to about 65° C. When Tg is 40° C. or more, the cohesive force of the resin itself in the high-temperature region is appropriate and generation of offset does not occur at the fixing. Also, when Tg is 80° C. or less, sufficient melting and a suitable minimum fixing temperature can be obtained.

Here, the melting temperature of the crystalline resin can be measured by using a differential scanning calorimeter (DSC) and can be determined as a melt peak temperature of the input compensation differential scanning calorimetry prescribed in JIS K-7121 when the measurement is performed by elevating the temperature at a rate of 10° C./min from room temperature to 150° C. The crystalline resin sometimes shows a plurality of melt peaks but in the present invention, the maximum peak is regarded as the melting temperature.

Also, the glass transition temperature of the noncrystalline resin indicates a value measured by the method prescribed in ASTM D3418-82 (DSC method).

The crystalline as denoted in the "crystalline polyester resin" means that the differential scanning calorimetry (DSC) shows not a stepwise change in the heat absorption but a distinct endothermic peak and specifically, the half-value width of the endothermic peak when measured at a temperature rising rate of 10° C./min is within 10° C.

On the other hand, when the half-value width of the endothermic peak exceeds 10° C. or a distinct endothermic peak is not observed, this means that the resin is noncrystalline (amorphous).

As for the binder resin which can be used in the electrostatic image developing toner of the present invention, in addition to the polyester carbonate resin or polyester amide resin, other polycondensed resins such as polyester resin may be used in combination. In the present invention, "a polyester carbonate resin, a polyester amide resin and other polycondensed resins" are sometimes collectively referred to simply as "a polycondensed resin".

Also, as for the binder resin which can be used in the electrostatic image developing toner of the present invention, it is preferred to use the polyester carbonate resin or polyester amide resin and an addition polymerization-type resin in combination.

In the electrostatic image developing toner of the present invention, out of the resin components contained, the addition polymerization-type resin preferably accounts for about 5 wt % to about 50 wt %, more preferably from about 6 wt % to about 30 wt %, still more preferably from about 8 wt % to about 20 wt %. Within this range, the effects of the present invention can be more successfully obtained.

The addition-polymerizable monomer which can be used for the production of the addition polymerization-type resin includes a radical polymerizable monomer, a cationic polymerizable monomer and an anionic polymerizable monomer, and a radical polymerizable monomer is preferred.

The radical polymerizable monomer is preferably a monomer having an ethylenically unsaturated bond, more preferably an aromatic vinyl monomer, a (meth)acrylic acid ester-based monomer, a vinyl ester-based monomer, a vinyl ether-based monomer, a monoolefin-based monomer, a diolefin-based monomer and/or a halogenated olefin-based monomer.

Examples of the aromatic vinyl monomer include a styrene-based monomer and a derivative thereof, such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

Examples of the (meth) acrylic acid ester-based monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

Examples of the vinyl ester-based monomer include vinyl acetate, vinyl propionate and vinyl benzoate.

Examples of the vinyl ether-based monomer include vinyl methyl ether, vinyl ethyl ether, vinyl isobutyl ether and vinyl phenyl ether. Examples of the monoolefin-based monomer include ethylene, propylene, isobutylene, 1-butene, 1-pentene and 4-methyl-1-pentene.

Examples of the diolefin-based monomer include butadiene, isoprene and chloroprene.

Examples of the halogenated olefin-based monomer include vinyl chloride, vinylidene chloride and vinyl bromide.

One of these monomers may be used alone, or two or more species thereof may be used in combination.

As for the polymerization method of the addition polymerizable monomer, a known polymerization method such as a method using a polymerization initiator, a self-polymerization method under heat, and a method using ultraviolet irradiation, may be employed. Among these, a method using a polymerization initiator is preferred. The polymerization initiator includes an oil-soluble initiator and a water-soluble initiator, an either initiator may be arbitrarily used by taking into consideration its decomposition temperature, that is, active temperature.

The polymerization of the addition-polymerizable monomer after emulsion-dispersion is not limited by any means in the present invention, and a so-called miniemulsion or microemulsion technique using a known polymerization initiator can be employed. Also, two kinds of polymerization methods, such as the above-described method and the conventional emulsion polymerization or suspension polymerization, may also be used in combination.

As for the polymerization method of the addition-polymerizable monomer, particularly, the radical polymerizable monomer, a method using a radical polymerization initiator, a self-polymerization method under heat, a method using ultraviolet irradiation, or a known polymerization method may be employed. In the case of the method using a radical initiator, the radical initiator includes an oil-soluble initiator and a water-soluble initiator, and either initiator may be used.

Specific examples of the radical polymerization initiator include azobisnitriles such as 2,2'-azobis(2-methylpropionitrile), 2,2'-azobis(2-methylbutyronitrile), 2,2'-azobisisobutyronitrile, 2,2'-azobis(2,4-dimethyl-valeronitrile), 2,2'-azobis (2,4-dimethyl-4-methoxyvalero-nitrile), 1,1'-azobis (cyclohexanecarbonitrile) and 2,2'-azobis(2-amidinopropane) hydrochloride; organic peroxides such as diacyl peroxide (e.g., acetyl peroxide, octanoyl peroxide, 3,5,5-trimethylhexanoyl peroxide, decanoyl peroxide, lauroyl peroxide, benzoyl peroxide), dialkyl peroxide (e.g., di-tert-butyl peroxide, tert-butyl-α-cumyl peroxide, dicumyl peroxide), peroxy ester (e.g., tert-butyl peroxyacetate, α-cumyl peroxypivalate, tert-butyl peroxyoctoate, tert-butyl peroxyneodecanoate, tert-butyl peroxylaurate, tert-butyl peroxybenzoate, di-tert-butyl peroxyphthalate, di-tert-butyl peroxyisophthalate), hydroperoxide (e.g., tert-butyl hydroperoxide, 2,5-dimethylhexane-2,5-dihydroperoxide, cumene hydroperoxide, diisopropylbenzene hydroperoxide) and peroxy carbonate (e.g., tert-butyl peroxyisopropylcarbonate); inorganic peroxides such as hydrogen peroxide; and persulfates such as potassium persulfate, sodiumpersulfate and ammonium persulfate. Also, a redox polymerization initiator may be used in combination.

A chain transfer agent may also be used at the addition polymerization. The chain transfer agent is not particularly limited but specifically, is preferably a compound having a covalent bond of carbon atom and sulfur atom, and preferred examples thereof include a thiol compound.

The weight average molecular weight of the addition polymerization-type resin which can be used in the present invention is preferably from about 5,000 to about 200,000, more preferably from about 10,000 to about 100,000.

In the case of dispersing the resin in an aqueous medium by using an addition-polymerizable monomer, a co-surfactant can be used so as to keep the average particle diameter of the resin-containing material (oil phase) containing the addition-polymerizable monomer in a specific range. As for the co-surfactant, a compound that is insoluble or sparingly soluble in water and soluble in the monomer and is used in the conventionally known "mini-emulsion polymerization", can be used.

Preferred examples of the co-surfactant include alkanes having a carbon number of 8 to 30, such as dodecane, hexadecane and octadecane; alkyl alcohols having a carbon number of 8 to 30, such as lauryl alcohol, cetyl alcohol and stearyl alcohol; alkyl (meth)acrylates having a carbon number of 8 to 30, such as lauryl (meth)acrylate, cetyl (meth)acrylate and stearyl (meth)acrylate; alkyl mercaptans having a carbon number of 8 to 30, such as lauryl mercaptan, cetyl mercaptan and stearyl mercaptan; other polymers or polyadducts such as polystyrene and polymethyl methacrylate; carboxylic acids; ketones; and amines.

Examples of the colorant that can be used in the electrostatic image developing toner of the present invention include various pigments such as carbon black, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine GB, DuPont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green, Malachite Green Oxalate and Titanium Black; and various dyes such as acridine type, xanthene type, azo type, benzoquinone type, azine type, anthraquinone type, thioindigo type, dioxazine type, thiazine type, azomethine type, indigo type, thioindigo type, phthalocyanine type, aniline black type, polymethine type, triphenylmethane type, diphenylmethane type, thiazine type, thiazole type and xanthene type.

Specific preferred examples of the colorant include carbon black, a nigrosine dye (C.I. No. 50415B) Aniline Blue (C.I. No. 50405), Calco Oil Blue (C.I. No. azoic Blue 3), Chrome Yellow (C.I. No. 14090), Ultramarine Blue (C.I. No. 77103), DuPont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Lamp Black (C.I. No. 77266), Rose Bengal (C.I. No. 45435), and a mixture thereof.

The amount of the colorant used is preferably from about 0.1 part by weight to about 20 parts by weight, more preferably from about 0.5 part by weight to about 10 parts by weight, per 100 parts by weight of the toner. As the colorant, one of these pigments and dyes may be used alone, or two or more thereof may be used in combination.

The method for dispersing the colorant may be an arbitrary method. For example, a general dispersing method using a rotary shear homogenizer or a media-containing ball mill, sand mill or dynomill may be employed without any limitation. The colorant particle may be added at one time to a mixed solvent together with other particle components or may be added in divided multiple stages.

In the case of using an emulsion polymerization aggregation method for the production of the electrostatic image developing toner of the present invention, a particle containing a binder resin and a colorant and having a toner particle diameter can be produced by generating aggregation due to pH change or the like in the aggregating step. At the same time, an aggregating agent may be added so as to stably and quickly aggregate the particles or obtain an aggregate particle having a narrow particle size distribution.

The aggregating agent is preferably a compound having monovalent or higher valent electric charge, and specific examples of the compound include the above-described water-soluble surfactants such as ionic surfactant and non-ionic surfactant; acids such as hydrochloric acid, sulfuric acid, nitric acid, acetic acid and oxalic acid; metal salts of inorganic acid, such as magnesium chloride, sodium chloride, aluminum sulfate, calcium sulfate, ammonium sulfate, aluminum nitrate, silver nitrate, copper sulfate and sodium carbonate; metal salts of aliphatic acid or aromatic acid, such as sodium acetate, potassium formate, sodium oxalate, sodium phthalate and potassium salicylate; and metal salts of phenols, such as sodium phenoxide.

Considering stability of the aggregate particle, stability of the aggregating agent against heat or aging, and removal at the washing, the aggregating agent is preferably a metal salt of an inorganic acid in view of performance or use. Specific examples of the metal salt of an inorganic acid include magnesium chloride, sodium chloride, aluminum sulfate, calcium sulfate, ammonium sulfate, aluminum nitrate, silver nitrate, copper sulfate and sodium carbonate.

The amount of the aggregating agent added varies depending on the valence of electric charge but is small in any case and is 3 wt % or less in the case of a monovalent compound, 1 wt % or less in the case of a divalent compound, and 0.5 wt % or less in the case of a trivalent compound. The amount of the aggregating agent is preferably smaller and therefore, a compound of higher valence is preferably used.

The electrostatic image developing toner of the present invention may contain a magnetic material or a characteristic improving agent, if desired. Examples of the magnetic material include a metal or alloy exhibiting ferromagnetic property, such as iron, cobalt and nickel, including ferrite and magnetite; a compound containing such an element; an alloy containing no ferromagnetic element but caused to exhibit ferromagnetic property when subjected to an appropriate heat treatment, for example, an alloy of the type called Whisler alloy containing manganese and copper, such as manganese-copper-aluminum and manganese-copper-tin; and chromium dioxide. For example, in the case of obtaining a black toner, magnetite which is black itself and exerts a function as a colorant may be preferably used. Also, in the case of obtaining a color toner, a magnetic material with little blackish tint, such as metallic iron, is preferred. Some of these magnetic materials function as a colorant and in such a case, the magnetic material may be used to serve also as the colorant. The content of such a magnetic material is, in the case of a magnetic toner, preferably from 20 to 70 parts by weight, more preferably from 40 to 70 parts by weight, per 100 parts by weight of the toner.

The characteristic improving agent includes a fixability enhancer, a charge control agent and the like. Examples of the fixability enhancer which can be used include a polyolefin, a fatty acid metal salt, a fatty acid ester, a fatty acid ester-based wax, a partially saponified fatty acid ester, a higher fatty acid, a higher alcohol, a fluid or solid paraffin wax, a polyamide-based wax, a polyhydric alcohol ester, a silicone varnish and an aliphatic fluorocarbon. In particular, a wax having a softening temperature (by the ring and ball method, JIS K2531) of 60 to 150° C. is preferred. As for the charge control agent, a conventionally known charge control agent may be used, and examples thereof include a nigrosine-based dye and a metal-containing dye.

The electrostatic image developing toner of the present invention is preferably used after mixing therein an inorganic fine particle such as flowability enhancer. The inorganic fine particle for use in the present invention preferably has a primary particle diameter of 5 nm to 2 μm, more preferably from 5 to 500 nm. Also, the specific surface area by the BET method is preferably from 20 to 500 $m^2/g$. The proportion of the inorganic fine particle mixed in the toner is preferably from 0.01 to 5 wt %, more preferably from 0.01 to 2.0 wt %. Examples of this inorganic particle include silica powder, alumina, titanium oxide, barium titanate, magnesium titanate, calcium titanate, strontium titanate, zinc oxide, silicas and, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride, with silica powder being preferred.

The silica powder as used herein means a powder having an Si—O—Si bond and includes both a silica powder produced by the dry process and a silica powder produced by the wet process. Also, the silica powder may be any of anhydrous silicon dioxide, aluminum silicate, sodium silicate, potassium silicate, magnesium silicate, zinc silicate and the like, but a silica powder containing 85 wt % or more of $SiO_2$ is preferred. Specific examples of the silica powder include commercially available various silicas, but those having a hydrophobic group on the surface are preferred, such as AEROSIL R-972, R-974, R-805 and R-812 (all produced by Aerosil Co.), and Talax 500 (produced by Talco Co.). Other than these, for example, a silica powder treated with a silane coupling agent, a titanium coupling agent, a silicon oil, a silicon oil having an amine in the branch, or the like, may be used.

The toner obtained is dried in the same manner as a normal toner and may be used after, for the purpose of imparting flowability and enhancing the cleaning property, adding an inorganic particle such as silica, alumina, titania and calcium carbonate, or a resin particle such as vinyl-based resin, polyester and silicone, to the toner particle surface while applying shear in a dry state.

In the case of attaching the inorganic particle or resin particle to the toner surface in an aqueous medium, all materials usually employed as an external additive to the toner surface, such as silica, alumina, titania, calcium carbonate, magnesium carbonate and tricalcium phosphate, may be used as the inorganic particle after dispersing such a material with an ionic surfactant, a polymer acid or a polymer base.

In the electrostatic image developing toner of the present invention, a charge control agent used for this type of toner may be used, if desired. In this case, the charge control agent may be formed into an aqueous liquid dispersion or the like, for example, at the initiation of production of the above-described monomer particle emulsion, at the initiation of polymerization, or at the initiation of aggregation of the resin particle.

The amount of the charge control agent added is preferably from 1 to 25 parts by weight, more preferably from 5 to 15 parts by weight, per 100 parts by weight of the binder resin.

The charge control agent may be a known charge control agent including, for example, a positive charging charge control agent such as nigrosine-based dye, quaternary ammonium salt-based compound, triphenylmethane-based compound, imidazole-based compound and polyamine-based resin, and a negative charging charge control agent such as metal (e.g., chromium, cobalt, aluminum, iron)-containing azo-based dye, metal (e.g., chromium, zinc, aluminum) salt or complex of hydroxycarboxylic acid (e.g., salicylic acid, alkylsalicylic acid, benzilic acid), amide compound, phenol compound, naphthol compound and phenolamide compound.

Also, in the electrostatic image developing toner of the present invention, waxes as a releasing agent used for this type of toner may be used, if desired. In this case, the releasing agent may be added in the form of an aqueous liquid dispersion or the like, for example, at the initiation of production of the above-described monomer emulsion, at the initiation of polymerization or at the initiation of aggregation of the polymer particle.

The amount of the releasing agent used is preferably from 1 to 25 parts by weight, more preferably from 5 to 15 parts by weight, per 100 parts by weight of the binder resin.

The releasing agent may be a known releasing agent including, for example, a polyolefin-based wax such as low molecular polyethylene, low molecular polypropylene and an ethylene-propylene copolymer; a vegetable wax such as paraffin-based wax, hydrogenated castor oil, carnauba wax and rice wax; a higher fatty acid ester-based wax such as stearic acid ester, behenic acid ester and montanic acid ester; an alkyl-modified silicone; a higher alcohol of stearic acid or the like, such as higher fatty acid stearyl alcohol; a higher fatty acid amide such as oleic acid amide and stearic acid amide; and a ketone having a long-chain alkyl group, such as distearyl ketone.

Furthermore, in the electrostatic image developing toner of the present invention, various known internal additives used for this type of toner, such as antioxidant and ultraviolet absorbent, may be used, if desired.

The volume average particle diameter ($D_{50v}$) of the electrostatic image developing toner of the present invention is preferably from about 2 μm to about 10 μm, more preferably from about 3 μm to about 8 μm, still more preferably from about 5 μm to about 7 μm.

The particle size distribution of the toner is preferably narrower. More specifically, the value (GSDp) which is a square root of the ratio between the 16% diameter (abbreviated as $D_{16p}$) and the 84% diameter (abbreviated as $D_{84p}$) in terms of the number of toner particles accumulated from the smaller particle diameter side, that is, $GSD_p$ represented by the following formula, is preferably about 1.40 or less, more preferably about 1.31 or less, still more preferably from about 1.20 to about 1.27.

$$GSDp=\{(D_{84p})/(D_{16p})\}^{0.5}$$

When the volume average particle diameter and GSDp both are in the ranges above, an extremely small particle is not present and therefore, reduction in developability due to the excessive amount of triboelectric charge of a small particle-size toner can be suppressed For the measurement of the average particle diameter of a particle such as resin particle or toner particle, Coulter Counter Model TA-II (manufactured by Coulter Corp.) can be used. In this case, the particle diameter is measured using an optimal aperture according to the particle diameter level of the particle. The measured particle diameter of the particle is expressed by the volume average particle diameter.

In the case where the particle diameter of the particle is about 5 μm or less, the particle diameter can be measured using a laser diffraction scattering particle size distribution measuring apparatus (LA-700, manufactured by Horiba, Ltd.).

Furthermore, the particle diameter in nanometer order is measured using a BET-type specific surface area measuring apparatus (Flow Sorb II2300, manufactured by Shimadzu Corp.).

The volume average primary particle diameter, number average particle size distribution index, volume average particle size distribution index and the like of aggregate particles produced can be measured by a measuring device such as Coulter Counter Model TA-II (manufactured by Coulter Corp.) and Multisizer II (manufactured by Nikkaki Co., Ltd.). An accumulated distribution of each of the volume and the number is drawn from the small diameter side with respect to the particle size range (channel) divided on the basis of particle size distribution, the particle diameter at 16% accumulation is defined as $D_{16V}$ by volume and $D_{16P}$ by number, the particle diameter at 50% accumulation is defined as $D_{50V}$ by volume and $D_{50P}$ by number, and the particle diameter at 84% accumulation is defined as $D_{84V}$ by volume and $D_{84P}$ by number. Using these, the volume average particle size distribution index (GSDv) can be calculated as $(D_{84V}/D_{16V})^{1/2}$, and the number average particle size distribution index (GSDp) can be calculated as $(D_{84P}/D_{16P})^{1/2}$.

The shape factor SF1 of the electrostatic image developing toner is preferably from about 110 to about 145, more preferably from about 120 to about 140.

The shape factor SF1 is a shape factor indicating the degree of unevenness on the particle surface and can be calculated by the following formula.

$$SF1 = \frac{(ML)^2}{A} \times \frac{\pi}{4} \times 100$$

In the formula, ML represents the maximum length of the particle, and A represents the projected area of the particle.

Specific examples of the method for measuring SF1 include a method where an optical micrograph of the toner or carrier scattered on a slide glass is incorporated into an image analyzer through a video camera, the SF1 is calculated for 50 toner or carrier particles, and an average value thereof is determined.

In the electrostatic image developing toner of the present invention, an internal additive may be added to the inside of the toner.

The internal additive is generally used for the purpose of controlling viscoelasticity of the fixed image. Specific examples of the internal additive include an inorganic particle such as silica and titania, and an organic particle such as polymethyl methacrylate. The internal additive may be surface-treated for enhancing the dispersibility. One of these internal additives may be used alone, or two or more species thereof may be used in combination.

In the electrostatic image developing toner of the present invention, an external additive such as fluidizing agent and charge control agent may be externally added.

As for the external additive, a known material may be used, and examples thereof include an inorganic particle surface-treated with a silane coupling agent or the like, such as silica particle, titanium oxide particle, alumina particle, cerium oxide particle and carbon black, a polymer particle such as polycarbonate, polymethyl methacrylate and silicone resin, an amine metal salt, and a salicylic acid metal complex. One of these external additives may be used alone, or two or more species thereof may be used in combination.

The external additive which can be used in the present invention is preferably an oxide containing a nitrogen atom, more preferably a silica particle containing a nitrogen atom. When the external additive is an oxide containing a nitrogen atom, the performance in terms of fogging at the change in the temperature and humidity environment, particularly at the change from a low-temperature low-humidity environment to a high-temperature high-humidity environment, and the image density are excellent.

Examples of the silica particle containing a nitrogen atom include a silica particle of which surface is treated with an aminosilane coupling agent.

(Production Method of Electrostatic Image Developing Toner)

The production method of the electrostatic image developing toner preferably includes a step of synthesizing a polyester carbonate resin or polyester amide resin having, as a monomer unit, from about 0.5 mol % to about 30 mol % of a dodecenylsuccinic acid unit (hereinafter sometimes referred to as a "polycondensed resin producing step"), a step of dispersing a resin containing the polyester carbonate resin or polyester amide resin in an aqueous medium to obtain a resin particle liquid dispersion (hereinafter sometimes referred to as a "dispersing step"), a step of aggregating the resin particles in a liquid dispersion containing at least the resin particle liquid dispersion and a colorant to obtain an aggregate particle (hereinafter sometimes referred to as an "aggregating step"), and a step of fusing together the aggregate particles by heating (hereinafter sometimes referred to as a "fusing step").

The electrostatic image developing toner of the present invention is preferably a toner produced by this production method.

The production method of the electrostatic image developing toner of the present invention preferably includes a step of synthesizing a polyester carbonate resin or polyester amide resin having, as a monomer unit, from 0.5 to 30 mol % of a dodecenylsuccinic acid unit (polycondensed resin producing step).

In the polycondensed resin producing step, a polycondensable monomer for forming the dodecenylsuccinic acid unit is preferably used in a range of about 0.5 mol % to about 30 mol %, more preferably from about 3 mol % to about 15 mol %, still more preferably from about 5 mol % to about 10 mol %, based on the total amount of the polycondensable monomers used.

Examples of the polycondensable monomer which can be used in the polycondensed resin producing step include, in addition to the polycondensable monomer for forming the dodecenylsuccinic acid unit, a polyvalent carboxylic acid, a polyhydric alcohol and a hydroxycarboxylic acid. Among these, a polyvalent carboxylic acid and a polyhydric alcohol are preferred, and a dicarboxylic acid and a diol are more preferred.

As for each of these dodecenylsuccinic acid unit-forming polycondensable monomer, polyvalent carboxylic acid, polyhydric alcohol and hydroxycarboxylic acid, one species may be used alone or two or more species may be used in combination.

The polycondensed resin producing step preferably includes a step of producing a polyester resin having a hydroxy group and a step of reacting the polyester resin having a hydroxy group with a compound represented by formula (2) to obtain a polyester carbonate resin or includes a step of producing a polyester resin having a carboxyl group and a step of reacting the polyester resin having a carboxyl group with a compound represented by formula (3) to obtain a polyester amide resin.

In the present invention, the polycondensed resin is preferably a polycondensed resin obtained by the polycondensation of a polycondensation component, more preferably by the polycondensation of a polycondensable monomer, still more preferably by the polycondensation in the presence of a polycondensation catalyst.

The polycondensation catalyst which can be used in the present invention is not particularly limited and a known polycondensation catalyst may be used, but it is preferred to use a sulfur acid, an acid having a surface active effect, a rare earth-containing catalyst, a hydrolase-type catalyst, a metal catalyst and/or a basic catalyst. Use of a rare earth-containing catalyst and/or a hydrolase-type catalyst is more preferred, and use of a sulfur acid is still more preferred.

The sulfur acid is an oxyacid of sulfur.

The sulfur acid includes an inorganic sulfur acid and an organic sulfur acid.

Examples of the inorganic sulfur acid include a sulfuric acid, a sulfurous acid and a salt thereof, and examples of the organic sulfur acid include sulfonic acids such as alkylsulfonic acid, arylsulfonic acid and salts thereof, and organic sulfuric acids such as alkylsulfuric acid, arylsulfuric acid and salts thereof.

The sulfur acid is preferably an organic sulfur acid, more preferably an organic sulfur acid having a surface active effect. Incidentally, the acid having a surface active effect is a compound having a chemical structure consisting of a hydrophobic group and a hydrophilic group, where at least a part of the hydrophilic group has an acid structure composed of a proton, and having both an emulsifying function and a catalyst function.

Examples of the organic sulfur acid having a surface active effect include an alkylbenzenesulfonic acid, an alkylsulfonic acid, an alkyldisulfonic acid, an alkyl-phenolsulfonic acid, an alkylnaphthalenesulfonic acid, an alkyltetralinsulfonic acid, an alkylallylsulfonic acid, a petroleum sulfonic acid, an alkylbenzimidazolesulfonic acid, a higher alcohol ether sulfonic acid, an alkyldiphenylsulfonic acid, a long-chain alkylsulfuric acid ester, a higher alcohol sulfuric acid ester, a higher alcohol ether sulfuric acid ester, a higher fatty acid amide alkylol sulfuric acid ester, a higher fatty acid amide alkylated sulfuric acid ester, a sulfated fat, a sulfosuccinic acid ester, a resin acid alcohol sulfuric acid, and salt compounds of all of these sulfur acids. A plurality of these sulfuric acids may be used in combination, if desired. Among these compounds, a sulfonic acid having an alkyl or aralkyl group, a sulfuric acid ester having an alkyl or aralkyl group, and a salt compound thereof are preferred. The carbon number of the alkyl or aralkyl group is preferably from 7 to 20. Specific examples of the organic sulfur acid include dodecylbenzenesulfonic acid, pentadecylbenzenesulLonic acid, isopropylbenzenesulfonic acid, comphorsulfonic acid, p-toluenesulfonic acid, monobutyl-phenylphenol sulfuric acid, dibutyl-phenylphenol sulfuric acid, dodecylsulfuric acid and naphthenyl alcohol sulfuric acid. Such a sulfuric acid may have some functional group in its structure.

The amount used of the sulfur acid which can be used in the present invention is preferably from about 0.05 wt % to about 20 wt %, more preferably from about 0.1 wt % to about 10 wt %, based on the total weight of polycondensation components.

When the amount of the sulfur acid used is in the above-described range, sufficient catalytic activity can be advantageously exerted. In particular, when the sulfur acid is added together with polycondensation components in an aqueous medium, this is preferred because stability of particles can be maintained, higher polycondensation reactivity is obtained, and the polycondensation reaction can proceed at a low temperature (preferably 150° C. or less, more preferably 130° C. or less, still more preferably 100° C. or less).

Examples of the acid having a surface active effect include various fatty acids, a higher alkylphosphoric acid ester, a resin acid, and salt compounds of all of these acids. A plurality of species may be used in combination, if desired.

Specific examples of the effective rare earth-containing catalyst include those containing scandium (Sc), yttrium (Y), lanthanum (La) as lanthanoid element, cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) or lutetium (Lu). In particular, those having an alkylbenzenesulfonate, an alkylsulfuric ester salt or a triflate structure are effective. Examples of the structural formula of the triflate include X $(OSO_2CF_3)_3$, wherein X is a rare earth element. Among the rare earth elements, X is preferably, for example, scandium (Sc), yttrium (Y), ytterbium (Yb) or samarium (Sm).

The lanthanoid triflate is described in detail in *Journal of Synthetic Organic Chemistry, Japan*, Vol. 53, No. 5, pp. 44-54.

The hydrolase-type catalyst is not particularly limited as long as it catalyzes an ester synthesis reaction. Examples of the hydrolase for use in the present invention include an esterase classified into EC (enzyme code) group 3.1 (see, for example, Maruo and Tamiya (supervisors), *Koso Handbook* (*Handbook of Enzyme*), Asakura-Shoten (1982)) such as carboxyesterase, lipase, phospholipase, acetylesterase, pectinesterase, cholesterol esterase, tannase, monoacylglycerol lipase, lactonase and lipoprotein lipase; a hydrolase classified into EC group 3.2 having activity on a glycosyl compound, such as glucosidase, galactosidase, glucuronidase and xylosidase; a hydrolase classified into EC group 3.3 such as epoxide hydrase; a hydrolase classified into EC group 3.4 having activity on a peptide bond, such as aminopeptidase, chymotrypsin, trypsin, plasmin and subtilisin; and a hydrolase classified into EC group 3.7 such as phloretin hydrase.

Among those esterases, an enzyme of hydrolyzing a glycerol ester and isolating a fatty acid is called a lipase. The lipase is advantageous in that, for example, this enzyme shows high stability in an organic solvent, catalyzes an ester synthesis reaction with good yield and is inexpensive. Accordingly, from the aspect of yield and cost, a lipase is preferably used also in the present invention.

Lipases of various origins may be used, but preferred examples thereof include a lipase obtained from micro-organisms of *Pseudomonas* group, *Alcaligenes* group, *Achromobacter* group, *Candida* group, *Aspergillus* group, *Rhizopus* group and *Mucor* group, a lipase obtained from plant seeds and a lipase obtained from animal tissues, and further include pancreatin and steapsin. Among these, preferred is a lipase originated in microorganisms of *Pseudomonas* group, *Candida* group and *Aspergillus* group.

Examples of the metal catalyst include, but are not limited to, an organic tin compound, an organic titanium compound, an organic titanium compound, an organic antimony compound, an organic beryllium compound, an organic strontium compound, an organic germanium compound and an organic tin halide compound.

In the case of using a metal catalyst as the catalyst, the content of the catalyst-originated metal in the obtained resin is preferably made to be 10 ppm or less, more preferably 7.5 ppm or less, still more preferably 5.0 ppm or less. Accordingly, a metal catalyst is preferably not used or even if used, the metal catalyst is preferably used in a very slight amount.

By making the metal content in the resin to be 10 ppm or less, the stability of resin particles in the resin particle liquid dispersion is enhanced and this is preferred.

Examples of the basic catalyst include, but are not limited to, a general organic base compound, a nitrogen-containing basic compound, and a tetraalkylphosphonium or tetraarylphosphonium hydroxide such as tetrabutylphosphonium hydroxide. Examples of the organic base compound include ammonium hydroxides such as tetra-methylammonium hydroxide and tetraethylammonium hydroxide; and examples of the nitrogen-containing basic compound include amines (e.g., triethylamine, dibenzylmethylamine), pyridine, methylpyridine, methoxypyridine, quinoline, imidazole, a hydroxide, hydride or amide of alkali metals (e.g., sodium, potassium, lithium, cesium) or alkaline earth metals (e.g., calcium, magnesium, barium), and a salt of an alkali or alkaline earth metal with an acid, such as carbonate, phosphate, borate and carboxylate, or with a phenolic hydroxyl group.

Other examples include a compound with an alcoholic hydroxyl group, and a chelate compound with acetylacetone, but the present invention is not limited thereto.

The total amount of the catalyst added is preferably from 0.05 to 20 wt %, more preferably from 0.1 to 10 wt %, based on the polycondensation component, and one species or a plurality of species may be added at the above-described proportion.

When the total amount of the catalyst is in this range, sufficiently high polycondensation reactivity is ensured and at the same time, the reverse or side reaction can be advantageously suppressed.

The reaction temperature at the polycondensation is preferably from 70 to 150° C., more preferably from 75 to 130° C., still more preferably from 80° C. to 100° C.

When the reaction temperature is 70° C. or more, reduction of reactivity, ascribable to decrease in the solubility of the polycondensation component, preferably polycondensable monomer, or decrease in the catalytic activity, does not occur, and the increase of the molecular weight is advantageously not suppressed. Also, the reaction temperature is 150° C. or less, the resin can be produced with low energy and this is preferred. Furthermore, to advantage, coloration of the obtained resin, decomposition of the produced polycondensed resin, or the like does not occur.

In order to avoid the conventional high energy consumption-type production process and reduce the production energy of resin or electrostatic image developing toner in comprehensive sense, it is very important to produce the polycondensed resin at a low temperature of 150° C. or less. The polycondensation reaction is heretofore performed at a high temperature exceeding 200° C., and for performing the polymerization at a low temperature of 150° C. or less which is from several tens to a hundred and several tens of ° C. lower than that, use of a sulfur acid catalyst is suitable. This is because the conventional metal catalyst of Sn type, Ti type or the like exhibits a high catalytic activity particularly at 200° C. or more but the activity at a low temperature of 150° C. or less is very low.

The sulfur acid has such a reaction mechanism as that the catalytic activity ability decreases with increase of the temperature at a high temperature of 160° C. but the reaction proceeds in the wake of nucleophilic addition of the catalyst acid. Therefore, the catalytic activity is high at a polymerization temperature of from about 70° C. to about 150° C. as well as in the low temperature range and the catalyst can be suitably used for the polycondensation reaction at 150° C. or less. Thus, the sulfur acid can be suitably used as the polycondensation catalyst in the present invention.

The polycondensation reaction may be performed by a general polycondensation process such as bulk polymerization, emulsion polymerization, in-water polymerization (e.g., suspension polymerization), solution polymerization and interface polymerization, but bulk polymerization and in-water polymerization are preferred. Above all, the polycondensed resin is preferably obtained by directly polycondensing the polycondensable monomer through bulk polymerization.

In the case of bulk polymerization, the reaction may be performed under atmospheric pressured, but when the purpose is, for example, to increase the molecular weight of the polycondensed resin obtained, general conditions such as reduced pressure or nitrogen stream can be employed.

The polycondensation component is preferably a polycondensable monomer, and the polycondensable monomer is preferably a polycarboxylic acid or a polyhydric alcohol, more preferably a dicarboxylic acid or a diol. Furthermore, the catalyst is preferably a sulfur acid and as described above, the polycondensation is preferably performed at 150° C. or less.

In other words, it is preferred to directly polymerize a polycondensable monomer at a low temperature of 150° C. or less by using a sulfuric acid as the catalyst.

The production method of the electrostatic image developing toner of the present invention preferably includes a step of dispersing a resin containing the polyester carbonate resin or polyester amide resin in an aqueous medium to obtain a resin particle liquid dispersion.

In the dispersing step, the dispersion is preferably performed by adding a surfactant or the like so as to increase the dispersion efficiency or enhance the stability of the resin particle liquid dispersion.

The method for dispersing the polycondensed resin in an aqueous medium and particulating the resin may also be selected known methods such as forced emulsification method, self-emulsification method and phase-inversion emulsifica-tion method. Among these, a self-emulsification method and a phase-inversion emulsification method are preferred in consideration of energy required for emulsification, controllability of particle diameter of the emulsified product obtained, safety and the like. The self-emulsification method and phase-inversion emulsification method are described in *Chobiryushi Polymer no Oyo Gijutsu* (*Applied Technology of Ultrafine Particulate Polymer*), CMC.

In the case of using an organic solvent in the dispersing step, the production method of the resin particle liquid dispersion may include a step of removing at least a part of the organic solvent and a step of forming resin particles. For example, the polycondensed resin-containing material having a terminal carboxy group after emulsification is preferably solidified as a particle by removing a part of the organic solvent. Specific examples of the method for solidification include a method of emulsion-dispersing the polycondensed resin-containing material in an aqueous medium and then drying the organic solvent at the air-liquid interface by feeding air or an inert gas such as nitrogen while stirring the solution (waste air drying method), a method of performing the drying by keeping the system under reduced pressure while, if desired, bubbling an inert gas (vacuum topping method), and a method of repeatedly ejecting an emulsion-dispersion liquid after the emulsion dispersion of the polycondensed resin-containing material in an aqueous medium or an emulsified liquid of the polycondensed resin-containing material to emerge in the form of a shower from small pores and fall on a dish-like receiver or the like, thereby performing the drying (shower-type solvent removal method). The solvent removal is preferably performed by appropriately selecting these methods individually or in combination according to the evaporation rate, solubility in water or the like of the organic solvent used.

As for the method of dispersing the polycondensed resin in an aqueous medium and particulating the resin, for example, a suspension polymerization method, a solution suspension method, a mini-emulsion method, a micro-emulsion method, a multistage swelling method or an emulsion polymerization method including seed polymerization, may be performed in an aqueous medium at the production of the polycondensed resin.

The basic substance used in the case of dispersing the polycondensed resin in an aqueous medium is not particularly limited and, for example, an alkali hydroxide (NaOH, KOH or LiOH) or an organic amine can be used. As for the basic substance used for the emulsification dispersion from immediately after the completion of polycondensation, a basic substance not containing a hydroxyl group is preferably used as the main component rather than an alkali hydroxide, and an organic amine-based material is particularly preferred. The organic amine-based material is not particularly limited as long as it is an organic amine such as ammonia, dimethylethanolamine, diethylethanolamine, triethanolamine, tripropanolamine, tributanolamine, triethylamine, propylamine, butylamine, isopropylamine, monomethanolamine, morpholine, methoxypropylamine, pyridine and vinylpyridine, but considering the use in combination with an emulsifier, the organic amine-based material is preferably an alkanolamine having high solubility in water, such as triethanolamine, more preferably a compound represented by formula (I).

The dispersion medium for the resin particle liquid dispersion, which can be used in the present invention, is an aqueous medium.

Examples of the aqueous medium which can be used in the present invention include water such as distilled water and ion-exchanged water, and alcohols such as ethanol and methanol. Among these, ethanol and water are preferred, and water such as distilled water and ion-exchanged water is more preferred. One species of these dispersion mediums may be used alone, or two or more species thereof may be used in combination. The aqueous medium may contain a water-miscible organic solvent. Examples of the water-miscible organic solvent include acetone and acetic acid.

When dispersing the polycondensed resin in an aqueous medium, the above-described materials are dispersed in the aqueous medium by using, for example, mechanical shear or ultrasonic wave and at this dispersion, a surfactant, a polymer dispersant, an inorganic dispersant or the like may be added to the aqueous medium, if desired. Also, an aqueous medium may be added to a mixture containing the polycondensed resin (oil phase) to allow the polycondensed resin to be finally emulsion-dispersed in the aqueous medium.

The median diameter (center diameter) of the resin particle liquid dispersion is preferably from 0.05 to 2.0 μm, more preferably from 0.1 to 1.5 μm, still more preferably from 0.1 to 1.0 μm. When the median diameter is in this range, the dispersed state of resin particles in an aqueous medium is stabilized as described above and this is preferred. Also, when used for the production of a toner, the particle diameter can be easily controlled and excellent releasability or high offset resistance can be advantageously obtained at the fixing.

The median diameter of the resin particle can be measured, for example, by a laser diffraction-type particle size distribution measuring apparatus (LA-920, manufactured by Horiba Ltd.).

It is also preferred that an addition-polymerizable monomer, particularly, a vinyl-based monomer such as styrene and acrylic acid ester is added to the polycondensed resin obtained and after emulsification dispersion, the addition-polymerizable monomer is polymerized using a polymerization initiator, particularly, a radical polymerization initiator.

In this case, the polymerization initiator may be added to a mixture containing the polycondensed resin and the addition-polymerizable monomer before emulsification dispersion but is preferably added to the aqueous medium.

Furthermore, after adding an addition-polymerizable monomer to the polycondensation component, the blend may be polycondensed in the presence of a catalyst, then emulsion-dispersed in an aqueous medium and further addition-polymerized using a polymerization initiator.

By virtue of containing an addition polymerization-type polymer in the resin particle, a hybrid resin (its particle) with a polycondensed resin can be obtained. Also, as for the addition-polymerizable monomer, the polymerization may also be performed by adding a new monomer after the polymerization of the polycondensation component.

In the present invention, as described above, the polycondensation reaction can be performed in the presence of an addition-polymerizable monomer and it is also possible to mix the addition-polymerizable monomer after the polycondensation reaction. By finally performing the addition polymerization of the addition-polymerizable monomer, a composite particle of a polycondensed resin and an addition polymerization-type polymer can be obtained.

The addition-polymerizable monomer which can be used in the present invention includes a radical polymerizable monomer, a cationic polymerizable monomer and an anionic polymerizable monomer and is preferably a radical polymerizable monomer.

The amount of the addition-polymerizable monomer added is preferably from 1.0 to 50.0 parts by weight, more preferably from 3.0 to 30.0 parts by weight, per 100 parts by weight of the polycondensed resin or polycondensation component. When the amount of the addition-polymerizable monomer added in this range, a toner excellent in the fixability and particle formability is obtained and this is preferred.

In the resin particle liquid dispersion obtained by dispersing a polyester in an aqueous medium, a surfactant described later may be added for increasing the dispersion efficiency or enhancing the stability of the resin particle liquid dispersion. Examples of the surfactant which can be used in the present invention include an anionic surfactant such as sulfate salt type, sulfonate salt type and phosphoric acid ester type; a cationic surfactant such as amine salt type and quaternary ammonium salt type; and a nonionic surfactant such as polyethylene glycol type, alkylphenol ethylene oxide adduct type and polyhydric alcohol type. Among these, an anionic surfactant and a cationic surfactant are preferred. The nonionic surfactant is preferably used in combination with the above-described anionic surfactant or cationic surfactant. One species of these surfactants may be used alone, or two or more species may be used in combination.

Examples of the anionic surfactant include sodium dodecylbenzenesulfonate, sodium alkylnaphthalenesulfonate, sodium arylalkylpolyethersulfonate, sodium 3,3'-disulfonediphenylurea-4,4'-diazo-bis-amino-8-naphthol-6-sulfonate, o-carboxybenzene-azo-dimethylaniline, sodium 2,2',5,5'-tetramethyltriphenylmethane-4,4'-diazo-bis-β-nap hthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate and calcium oleate.

Examples of the cationic surfactant include alkylbenzenedimethylammonium chloride, alkyltrimethyl-ammonium chloride and distearylammonium chloride.

Examples of the nonionic surfactant include polyethylene oxide, polypropylene oxide, a combination of polypropylene oxide and polyethylene oxide, an ester of polyethylene glycol and higher fatty acid, an alkylphenol polyethylene oxide, an ester of higher fatty acid and polyethylene glycol, an ester of higher fatty acid and polypropylene oxide, and a sorbitan ester.

In the resin particle liquid dispersion, a polymer dispersant or a stabilization aid may be added.

Examples of the polymer dispersant include sodium polycarboxylate and polyvinyl alcohol; and examples of the inorganic dispersant include calcium carbonate, but the present invention is not limited thereto by any means.

Furthermore, higher alcohols as typified by heptanol and octanol, or higher aliphatic hydrocarbons as typified by hexadecane, may also be blended as a stabilization aid so as to prevent the Ostwald ripening phenomenon of the monomer emulsion particle in an aqueous medium.

The toner obtained by the production method of the electrostatic image developing toner preferably has an average particle diameter of 1 to 10 μm. Also, the toner particle preferably contains a colorant in an amount of 0.1 to 50 parts by weight, more preferably from 0.5 to 40 parts by weight, still more preferably from 1 to 25 parts by weight, per 100 parts by weight of the polyester.

In the aggregating step, for example, the resin particle liquid dispersion is mixed with a colorant particle liquid dispersion and if desired, with a releasing agent particle liquid dispersion and the like, an aggregating agent is added to cause hetero-aggregation and thereby form an aggregate particle having a toner size, and the aggregate particles are fused and coalesced by heating to a temperature higher than the glass transition temperature or melting temperature of the resin particle, then washed and dried to obtain a toner. In the present invention, other resin particle may be used in the aggregating step.

As for the toner shape, a toner having a shape from amorphous to spherical is preferably used.

In the aggregating step, the resin particle liquid dispersion is mixed with a colorant liquid dispersion and if desired, with a releasing agent particle liquid dispersion and the like, and an aggregating agent is further added to cause hetero-aggregation of the particles, whereby an aggregate particle having a toner size can be formed. In each of those liquid dispersions, the medium is preferably an aqueous medium.

After thus forming a first aggregate particle by aggregation, the above-described resin particle liquid dispersion or another resin particle liquid dispersion may be further added to form a second shell layer on the surface of the first particle. In this example, a colorant liquid dispersion is separately prepared, but when a colorant is previously blended with the polycondensed resin particle, a colorant liquid dispersion is not necessary.

As for the aggregating agent, other than the surfactant, an inorganic salt or a divalent or higher valent metal salt may be suitably used. In particular, when a metal salt is used, this is preferred in view of aggregation control and toner chargeability. Also, a surfactant may be used, for example, for emulsion polymerization of resin, dispersion of pigment, dispersion of resin particle, dispersion of releasing agent, aggregation, or stabilization of aggregate particle.

The dispersing unit may be a general dispersing device such as rotary shear homogenizer and media-containing ball mill, sand mill or dynomill.

In the present invention, the above-described aggregation method is not particularly limited, and an aggregation method conventionally employed in the emulsion-polymerization aggregation method of an electrostatic image developing toner, such as a method of reducing the stability of emulsion by the elevation of temperature, change of pH, addition of salt or the like and stirring the emulsion with a disperser or the like, may be used.

After the aggregation treatment, for the purpose of, for example, suppressing the bleed-out of the colorant from the particle surface, a heat treatment or the like may be applied to thereby crosslink the particle surface. The surfactant and the like used may be removed by water washing, acid washing, alkali washing or the like, if desired.

In the production method of the electrostatic image developing toner, other than the polycondensed resin particle liquid dispersion, an addition polymerization-type resin particle liquid dispersion produced using the conventionally known emulsion polymerization or the like may be used together. The median diameter of the resin particle in the addition polymerization-type resin particle liquid dispersion which can be used in the present invention is preferably from 0.1 to 2.0 μm similarly to the above-described resin particle liquid dispersion.

Preferred examples of the addition-polymerizable monomer for producing such an addition polymerization-type resin particle liquid dispersion include the above-described addition-polymerizable monomers. In the case of an addition-polymerizable monomer, a resin particle liquid dispersion can be produced by performing emulsion polymerization using an ionic surfactant or the like, and in the case of other resins, when the resin is oily and dissolves in a solvent having a relatively low solubility in water, the resin is dissolved in such a solvent and dispersed into particles in an aqueous medium together with an ionic surfactant or a polymer electrolyte by using a dispersing device such as homogenizer, and then the solvent is evaporated by heating or reduced pressure, whereby the resin particle dispersion liquid can be obtained. The above-described polymerization initiator or chain transfer agent may be used at the polymerization of the addition-polymerizable monomer.

In the fusing step, the binder resin in the aggregate particle is melted under the temperature condition not lower than the melting temperature or glass transition temperature of the resin, and the aggregate particle changes from an irregular shape to a more spherical shape. Thereafter, the aggregation product is separated from the aqueous medium and, if desired, subjected to washing and drying, whereby a toner particle is formed.

After the completion of the aggregating and fusing steps, the toner particle may be arbitrarily passed through a washing step, a solid-liquid separation step and a drying step to obtain a desired toner. In view of chargeability, the washing step is preferably performed by thorough displacement and washing with ion exchanged water. The solid-liquid separation step is not particularly limited but in view of productivity, suction filtration, pressure filtration or the like is preferably used. The drying step is also not particularly limited but in view of productivity, freeze drying, flash jet drying, fluidized drying, vibration-type fluidized drying and the like are preferred.

In the production method of the electrostatic image developing toner of the present invention, various known internal additives such as electric charge control agent, antioxidant and ultraviolet absorbent used for this type of toner may be used, if desired.

The electric charge control agent may be added at any time such as at the preparation of emulsified dispersion (oil phase), at the emulsion dispersion, or at the aggregation. The electric charge control agent is preferably added in the form of an aqueous liquid dispersion or the like, and as for the amount of the electric charge control agent added, the electric charge control agent is preferably added to occupy from 1 to 25 parts by weight, more preferably from 5 to 15 parts by weight, per 100 parts by weight of the oil phase.

The oil phase as used herein indicates, in the case of bulk polymerization, a component containing at least a polycondensable resin and being emulsion-dispersed in an aqueous medium, and in the case of in-water polymerization, a component containing at least a polycondensation component and being emulsion-dispersed in an aqueous medium.

The electric charge control agent may be a known electric charge control agent including, for example, a positive charging electric charge control agent such as nigrosine-based dye, quaternary ammonium salt-based compound, triphenylmethane-based compound, imidazole-based compound and polyamine-based resin, and a negative charging electric charge control agent such as metal (e.g., chromium, cobalt, aluminum, iron)-containing azo-based dye, metal (e.g., chromium, zinc, aluminum) salt or complex of hydroxycarboxylic acid (e.g., salicylic acid, alkylsalicylic acid, benzilic acid), amide compound, phenol compound, naphthol compound and phenolamide compound.

(Electrostatic Charge Developer)

The electrostatic image developing toner of the present invention can be used as an electrostatic image developer. The electrostatic image developer is not particularly limited except for containing this electrostatic image developing toner and can take an appropriate composition of components according to the purpose. The electrostatic image developing toner is prepared as a one-component electrostatic image developer when used alone, and is prepared as a two-component electrostatic image developer when used in combination with a carrier.

The carrier is not particularly limited and includes carriers which are per se known. For example, a known carrier such as resin-coated carrier described in JP-A-62-39879 and JP-A-56-11461 may be used.

Specific examples of the carrier include the following resin-coated carriers. That is, the core particle of the carrier includes a normal iron powder, ferrite or magnetite shaped article, and the average particle diameter thereof is preferably from 30 to 200 μm. Examples of the coat resin of the core particle include styrenes such as styrene, p-chlorostyrene and α-methylstyrene; α-methylene fatty acid monocarboxylic acids such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate; nitrogen-containing acryls such as dimethylaminoethyl methacrylate; vinyl nitrites such as acrylonitrile and methacrylonitrile; vinyl pyridines such as 2-vinylpyridine and 4-vinylpyridine; vinyl ethers such as vinyl methyl ether and vinyl isobutyl ether; vinyl ketones such as vinyl methyl ketone, vinyl ethyl ketone and vinyl isopropenyl ketone; polyolefins such as ethylene and propylene; silicones such as methyl silicone and methyphenyl silicone; copolymers of fluorine-containing vinyl-based monomer, such as vinylidene fluoride, tetrafluoroethylene and hexafluoroethylene; polyesters containing bisphenol, glycol or the like; an epoxy resin; a polyurethane resin; a polyamide resin; a cellulose resin; and a polyether resin. One of these resins may be used alone, or two or more species thereof may be used in combination. The amount of the coat resin is preferably on the order of 0.1 to 10 parts by weight, more preferably from 0.5 to 3.0 parts by weight, based on the carrier.

In the production of the carrier, a heating-type kneader, a heating-type Henschel mixer, a UM mixer or the like can be used. Depending on the amount of the coat resin, a heating-type fluidized rolling bed, a heating-type kiln or the like can be used.

In the electrostatic image developer, the mixing ratio between the electrostatic latent image developing toner and the carrier is not particularly limited and may be appropriately selected according to the purpose.

(Image Forming Method)

The electrostatic image developer (electrostatic image developing toner) may be used for an image forming method in a normal electrostatic image developing system (electrophotographic system).

The image forming method of the present invention preferably includes a latent image forming step of forming an electrostatic latent image on the surface of a latent image carrier, a developing step of developing the electrostatic latent image formed on the surface of the latent image carrier with a developer containing a toner to form a toner image, a transfer step of transferring the toner image formed on the surface of the latent image carrier onto the surface of a transfer member, and a fixing step of heat-fixing the toner image transferred to the surface of the transfer member. The image forming method includes a cleaning step, if desired.

The above-described steps each is itself a general step and described, for example, in JP-A-56-40868and JP-A-49-91231. Incidentally, the image forming method of the present invention may be performed by using an image forming apparatus which is per se known, such as copying machine and facsimile machine.

The latent image forming step is a step of forming an electrostatic latent image on an electrostatic latent image carrier.

The developing step is a step of developing the electrostatic latent image with a developer layer on a developer carrier to form a toner image. The developer layer is not particularly limited as long as it contains the electrostatic image developer of the present invention containing the electrostatic image developing toner of the present invention.

The transfer step is a step of transferring the toner image onto a transfer member.

The fixing step is a step of fixing the toner image on the transfer member such as paper by using a heat roller fixing device or the like with the heat roller temperature being set to a constant temperature, to form a copy image.

The cleaning step is a step of removing the electrostatic image developer remaining on the electrostatic latent image carrier. In a preferred embodiment, the image forming method of the present invention further includes a recycling step.

The recycling step is a step of returning the electrostatic image developing toner collected in the cleaning step to the developer layer. The image forming method in the embodiment including a recycling step can be implemented using an image forming apparatus such as toner recycling system-type copying machine or facsimile machine. The image forming method of the present invention may also be applied to a recycling system in an embodiment where the cleaning step is omitted and the toner is collected simultaneously with the development.

(Image Forming Apparatus)

The image forming apparatus of the present invention includes a latent image carrier, an electrically charging unit for electrically charging the latent image carrier, an exposure unit for exposing the electrically charged latent image carrier to form an electrostatic latent image on the latent image carrier, a developing unit for developing the electrostatic latent image with a developer containing a toner to form a toner image, and a transfer unit for transferring the toner image onto a transfer member from the latent image carrier, and includes, if desired, a fixing unit for fixing the toner image on the fixing substrate. In the transfer unit, transfer may be performed twice or more by using an intermediate transfer member.

For the latent image carrier and units described above, the constructions described above in respective steps of the image forming method can be preferably used.

Also, for all of the units described above, a unit known in the image forming apparatus can be utilized. The image forming apparatus of the present invention may include a unit, an apparatus and the like other that the above-described constructions. Furthermore, in the image forming apparatus of the present invention, a plurality of operations out of operations in those units may be performed at the same time.

EXAMPLES

The present invention is described in greater detail below by referring to Examples, but the present invention is not limited to these Examples.

The electrostatic image developing toner in an exemplary embodiment of the invention is produced by preparing each of the following resin particle liquid dispersion, colorant particle liquid dispersion and releasing agent particle liquid dispersion, mixing these liquid dispersions at a predetermined ratio, and ionically neutralizing the mixture by adding a metal salt polymer with stirring, thereby forming an aggregate particle.

Subsequently, the pH in the system is adjusted from weakly acidic to neutral by adding an inorganic hydroxide, and the system is heated to a temperature higher than the glass transition temperature or melting temperature of the resin particle to fuse and coalesce the aggregate particles.

After the completion of reaction, a desired toner is obtained through the steps of thorough washing, solid-liquid separation and drying. The preparation method of each liquid dispersion and the measuring methods of respective characteristic values are described below.

<Measurement of Melting Temperature and Glass Transition Temperature>

The measurement is performed according to the differential scanning calorimetry (DSC) by using "DSC-20" (manufactured by Seiko Instruments & Electronics Ltd.), where 10 mg of a sample is heated at a constant temperature rising rate (10° C./min) and the melting temperature and glass transition temperature are determined from the base line and the heat absorption peak.

<Measurement of Weight Average Molecular Weight Mw and Number Average Molecular Weight Mn>

As for the values of the weight average molecular weight Mw and the number average molecular weight Mn, the weight average molecular weight Mw and the number average molecular weight Mn are measured by gel permeation chromatography (GPC) under the conditions described below. The measurement is performed at a temperature of 40° C. by flowing a solvent (tetrahydrofuran) at a flow velocity of 1.2 ml/min, and injecting 3 mg as the sample weight of a tetrahydrofuran sample solution in a concentration of 0.2 g/20 ml. At the measurement of the molecular weight of the sample, the measurement conditions are selected such that the molecular weight of the sample is included in the range where a straight line is formed by a logarithm of the molecular weight in the calibration curve created from several kinds of monodisperse polystyrene standard samples and a counted number.

In this connection, the reliability of the measurement results can be confirmed from the fact that the molecular weight of an NBS706 polystyrene standard sample measured under the above-described conditions becomes:

weight average molecular weight $Mw=28.8\times10^4$ number average molecular weight $Mn=13.7\times10^4$ As for the column of GPC, TSK-GEL, GMH (produced by Tosoh Corp.) is used.

The solvent and measurement temperature are changed to appropriate conditions according to the sample measured.

In the case where a resin particle liquid dispersion using an aliphatic polyester as the polyester and an aromatic-containing monomer as the addition-polymerizable resin is produced, when analyzing the molecular weights of these two materials by GPC, each molecular weight may also be analyzed by post-mounting an apparatus of separating UV and RI as a detector.

<Measurement of Average Particle Diameter of Particle>

In the measurement of the average particle diameter of particles, Coulter Counter Model TA-II (manufactured by Coulter Corp.) is used. In this case, the particle diameter is measured using an optimal aperture according to the particle diameter level of the particle. The measured particle diameter of the particle is expressed by the volume average particle diameter.

In the case where the particle diameter of the particle is about 5 μm or less, the particle diameter is measured using a laser diffraction scattering particle size distribution measuring apparatus (LA-700, manufactured by Horiba, Ltd.).

The particle diameter in nanometer order is measured using a BET-type specific surface area measuring apparatus (Flow Sorb II2300, manufactured by Shimadzu Corp.).

The volume average primary particle diameter, volume average particle size distribution index $GSD_v$ and number average particle size distribution index $GSD_p$ are measured and calculated as follows.

An accumulated distribution of each of the volume and the number of individual particles is drawn from the small diameter side with respect to the particle size range (channel) divided on the basis of the toner particle size distribution which is measured using a measuring device such as Coulter Counter Model TA-II (manufactured by Coulter Corp.) and Multisizer II (manufactured by Coulter Corp.), the particle diameter at 16% accumulation is defined as volume average particle diameter $D_{16V}$ and number average particle diameter $D_{16P}$, the particle diameter at 50% accumulation is defined as volume average particle diameter $D_{50V}$ and number average particle diameter $D_{50P}$, and the particle diameter at 84% accumulation is defined as volume average particle diameter $D_{84V}$ and number average particle diameter $D_{84P}$. Then, using relational expressions defining the volume average particle size distribution index (GSDv) as $D_{84V}/D_{16V}$ and defining the number average particle size distribution index (GSDp) as $D_{84P}/D_{16P}$, the volume average particle size distribution index (GSOv) and number average particle size distribution index (GSDp) are calculated.

Example 1

<Production of Resin 1>

(Polyvalent Carboxylic Acid Monomer)

Dimethyl terephthalate: 776.8 parts by weight (40 mol %)

Fumaric acid: 110.2 parts by weight (9.5 mol %)

Dodecenylsuccinic anhydride: 13.4 parts by weight (0.5 mol %)

(Polyhydric Alcohol Component)

Bisphenol A-ethylene oxide 2 mol adduct: 949.2 parts by weight (30 mol %)

Bisphenol A-propylene oxide 2 mol adduct: 516.6 parts by weight (15 mol %)

Into a flask equipped with a stirring device, a nitrogen inlet tube, a temperature sensor and a reduced-pressure rectification tower and having an inner volume, the polyvalent carboxylic acid monomer and polyhydric alcohol component above are charged and heated at 150° C. for 2 hours in a nitrogen atmosphere. After confirming that the inside of the reaction system is uniformly stirred, 32.0 parts by weight of catalyst dodecylbenzenesulfonic acid is charged.

Furthermore, the reactor is pressure-reduced to 10 kPa or less and while distilling off the produced water, heating is continued at the same time for 6 hours. Thereafter, 126.2 parts by weight (5 mol %) of carbonylbis(1-caprolactam) is added and the reaction temperature is raised to 180° C. The reaction is further continued, and a sample is collected halfway from the polymerization system and the weight average molecular weight is measured by GPC. At the point where the weight average molecular weight becomes 21,000, the system is cooled and the reaction is terminated. The weight average molecular weight Mw of the resin taken out and its peak molecular weight Mrp are 21,200 and 9,150, respectively, the number average molecular weight Mn is 4,000, and the glass transition temperature Tg is 58.6° C. Also, it is confirmed by the absorption at 1,744 $cm^{-1}$ and 1,262 $cm^{-1}$ in an infrared absorption spectrum (8,400S, manufactured by Shimadzu Corp.) that a carbonate bond is produced in the structure of the polymerized resin.

<Preparation of Resin Particle Liquid Dispersion 1>

200 Parts by weight of methyl ethyl ketone (MEK) in which 0.8 parts by weight of sodium dodecylbenzenesulfonate is dissolved, and 40 parts by weight of isopropyl alcohol (IPA) are added to 400 parts by weight of Resin 1, and the blend is charged into a reaction vessel with a reflux condenser, a stirrer, an ion-exchanged water dropping device and a heating device and thoroughly mixed at 65° C. Thereafter, 3 parts by weight of an aqueous 25% ammonia solution is added, and the blend is mixed under heating at 65° C. for 1 hour. Furthermore, 1,000 parts by weight of ion-exchanged water is dropped at a rate of 1 part by weight/min to perform the phase-inversion emulsification of Resin 1 and after cooling, MEK and IPA are removed from the emulsified solution at 60° C./reduced pressure by using an evaporator to obtain Resin Particle Liquid Dispersion 1. In the obtained resin particle liquid dispersion, the volume average diameter of the resin particle is 185 nm, the solid content concentration is 42.5%, and the residual MEK amount and residual IPA amount each is 80 ppm.

<Preparation of Colorant Particle Liquid Dispersion>

Cyan pigment (Pigment Blue 15:3 (copper phthalocyanine, produced by Dainichiseika Color & Chemicals Mfg. Co., Ltd.) 1,000 parts by weight Anionic surfactant (NEOGEN R, produced by Dai-Ichi Kogyo Seiyaku Co., Ltd.): 150 parts by weight Ion-exchanged water: 9,000 parts by weight These components are mixed and dissolved, and the resulting solution is dispersed for about 1 hour by using a high-pressure impact-type dispersing machine Altimizer (HJP30006, manufactured by Sugino Machine Ltd.) to prepare a colorant liquid dispersion where a colorant (cyan pigment) is dispersed. In the colorant liquid dispersion, the average particle diameter of the colorant (cyan pigment) is 0.15 μm and the colorant particle concentration is 23 wt %.

<Preparation of Releasing Agent Particle Liquid Dispersion>

Ester wax (WE-2, produced by NOF Corporation, melting temperature: 65° C.): 50 parts by weight Anionic surfactant (NEOGEN RK, produced by Dai-Ichi Kogyo Seiyaku Co., Ltd.): 5 parts by weight Ion-exchanged water: 200 parts by weight These components are heated at 95° C. and dispersed in a homogenizer (Ultraturrax T50, manufactured by IKA Works, Inc.), and the dispersion is then subjected to a dispersion treatment in Manton-Gaulin High-Pressure Homogenizer (manufactured by Gaulin) to prepare a releasing agent particle liquid dispersion where a releasing agent having an average particle diameter of 230 nm is dispersed (releasing agent concentration: 20 wt %).

<Production of Toner Particle 1>

Resin Particle Liquid Dispersion 1: 565 parts by weight (solid content: 240 parts by weight)

Colorant particle liquid dispersion: 22.87 parts by weight (solid content: 5.3 parts by weight)

Releasing agent particle liquid dispersion: 50 parts by weight (solid content: 10 parts by weight)

Out of these raw materials, the raw materials other than 158 parts by weight (solid content: 67 parts by weight) of Resin Particle Liquid Dispersion 1 all are charged into a cylindrical stainless steel vessel, and the blend is dispersed and mixed for 30 minutes by Ultraturrax at 8,000 rpm while applying shearing force. Subsequently, 0.14 parts by weight of an aqueous 10% nitric acid solution of polyaluminum chloride as a coagulant is added dropwise. At this time, the pH of the raw material liquid dispersion is controlled to a range of 4.2 to 4.5. If desired, the pH is adjusted with 0.3N nitric acid or an aqueous 1N sodium hydroxide solution. Thereafter, the raw material liquid dispersion is transferred to a polymerization kettle equipped with a stirring device and a thermometer and heated to accelerate the growth of attached aggregate particles at 40° C. and at the point where the volume average particle diameter becomes 5.0 μm, 158 parts by weight of Resin Particle Liquid Dispersion 1 set aside above is gradually added. The temperature is elevated to 50° C. to grow the particle diameter to 6.0 μm. Furthermore, the pH is raised to 7.5 and after elevating the temperature to 90° C. and keeping the system at 90° C. for 6 hours, the pH is gradually lowered to 6.5. Then, the heating is stopped and the particles are allowed to cool, sieved through a 45 μm mesh, repeatedly washed with water and dried by a freeze dryer to obtain Toner Particle 1. The volume average particle diameter of the final toner particle is measured using Coulter Counter Model TA-II (aperture diameter: 50 μm, manufactured by Coulter Corp.) and it is found that the particle diameter is 6.1 μm and the volume average particle diameter distribution is 1.21.

Also, the peak value Mtp of the weight average molecular weight of the resin in the toner particle after drying is measured and found to be 9,150, revealing that the molecular peak value Mrp immediately after the polymerization of the resin is 100% maintained.

<Production and Evaluation of Electrostatic Image Developer 1>

1 Part by weight of colloidal silica (R972, produced by Nippon Aerosil Co., Ltd.) is externally added to 100 parts by weight of Toner Particle 1 obtained above, and the blend is mixed using a Henschel mixer to obtain Electrostatic Image Developing Toner 1.

Separately, 100 parts of ferrite particle (produced by Powdertech Co., Ltd., average particle diameter: 50 μm) and 1 part of methacrylate resin (produced by Mitsubishi Rayon Co., Ltd., molecular weight: 95,000) are charged into a pressure kneader together with 500 parts of toluene, and the blend is mixed at ordinary temperature for 15 minutes and after distilling off the toluene by elevating the temperature to 70° C. while mixing the system under reduced pressure, subjected to cooling and size classification using a sieve of 105 μm to produce a ferrite carrier (resin-coated carrier). This ferrite carrier and Electrostatic Image Developing Toner 1 are mixed to produce Electrostatic Image Developer 1 of two-component system having a toner concentration of 7 wt %.

This electrostatic image developer is measured and evaluated for the absolute value of the amount of triboelectric charge (μC/g) in an environment of 80% RH and 28° C. by using a blow-off electric charge measuring apparatus (TB200, manufactured by Toshiba Chemical K.K.), as a result, the amount of the triboelectric charge of the toner is −42 μC/g revealing good initial electric chargeability.

Furthermore, in order to evaluate the fixability and image quality, 50,000 sheets are continuously printed at a fixing temperature of 140° C. and an image density of 5% by using a modified machine of Color DocuTech 60V manufactured by Fuji Xerox Co., Ltd., and the image quality (image dropout, scattering and image unevenness) is evaluated every 1,000 sheets. Also, the presence or absence of toner breakage in the developing machine is evaluated by observing a toner sampled from the developing machine through SEM. As a result, in all cases, no problem arises in practice, good image quality characteristics are exhibited without image dropout, scattering and image unevenness, and generation of toner breakage is not observed.

In addition, for evaluating the toughness and adherence to paper of the toner resin after fixing, the image area is scratched by a pencil having a hardness of H (YUNI, produced by Mitsubishi Pencil Co., Ltd.), and the presence or absence of interfacial fracture between the fixed toner and paper is confirmed, as a result, neither removal of image nor cohesion failure occurs, revealing that the toner resin has practically sufficient toughness and adherence.

Example 2

<Production of Resin 2>

Polymerization of Resin 2 is performed according to the following monomer formulation in the same manner as in Example 1.

(Polyvalent Carboxylic Acid Monomer)

Dimethyl terephthalate: 388.4 parts by weight (20 mol %)

Dodecenylsuccinic anhydride: 805.2 parts by weight (30 mol %)

(Polyhydric Alcohol Component)

Bisphenol A-ethylene oxide 2 mol adduct: 791 parts by weight (25 mol %)

Bisphenol A-propylene oxide 2 mol adduct: 516.6 parts by weight (15 mol %)

These polyvalent carboxylic acid monomer and polyhydric alcohol component are subjected to a reaction at 150° C. in the same manner as in Example 1 and after adding 252.3 parts by weight (10 mol %) of carbonylbis 1-caprolactam), the reaction is continued at 180° C. When the weight average molecular weight by GPC molecular weight measurement reaches 20,500, the reaction is terminated. The resin taken out is found to have a weight average molecular weight Mw of 20,500, a peak molecular weight Mrp of 9,320, a number average molecular weight of 4,020, and a Tg of 57.5° C.

<Preparation of Resin Particle Liquid Dispersion 2>

Resin Particle Liquid Dispersion 2 is prepared using Resin 2 in the same manner as in Example 1. The obtained liquid dispersion is found to have a volume average particle diameter of 187 nm and a solid content concentration of 42.5%. Also, the residual MEK amount and the residual IPA amount each is found to be 60 ppm.

<Preparation of Toner Particle 2>

A toner is produced in the same manner as in Example I by using the colorant particle liquid dispersion and releasing agent particle liquid dispersion prepared in Example 1 and using Resin Particle Liquid Dispersion 2 prepared above. The toner particle after drying is found to have a volume average particle diameter of 6.1 μm and a volume average particle diameter distribution of 1.22. Also, the weight average molecular weight of the dried toner shows a peak value Mtp of 9,320, revealing that the peak retention percentage is 100%.

<Production and Evaluation of Electrostatic Image Developer 2>

Electrostatic Image Developer 2 is produced using Toner Particle 2 in the same manner as in Example 1.

Then, this developer is evaluated in the same manner as in Example 1 for the amount of triboelectric charge, image quality, toner breakage and adherence to paper. As a result, the amount of triboelectric charge is −45 μC/g, revealing good electric chargeability. Also, no problem is observed in all of evaluations of image quality, toner breakage and adherence to paper, and excellent toner characteristics are exhibited.

Example 3

<Production of Resin 3>

Polymerization of Resin 3 is performed according to the following monomer formulation in the same manner as in Example 1.

(Polyvalent Carboxylic Acid Monomer)

Dimethyl terephthalate: 582.6 parts by weight (30 mol %)

Dodecenylsuccinic anhydride: 536.8 parts by weight (20 mol %)

(Polyhydric Alcohol Component)

Bisphenol A-ethylene oxide 2 mol adduct: 632.8 parts by weight (20 mol %)

Bisphenol A-propylene oxide 2 mol adduct: 516.6 parts by weight (15 mol %)

These polyvalent carboxylic acid monomer and polyhydric alcohol component are subjected to a reaction at 150° C. in the same manner as in Example 1 and after adding 378.5 parts by weight (15 mol %) of carbonylbis (1-caprolactam), the reaction is continued at 180° C. When the weight average molecular weight by GPC molecular weight measurement reaches 20, 100, the reaction is terminated. The resin taken out is found to have a weight average molecular weight Mw of 20,130, a peak molecular weight Mrp of 9,220, a number average molecular weight of 4,050, and a Tg of 60.5° C.

<Preparation of Resin Particle Liquid Dispersion 3>

Resin Particle Liquid Dispersion 3 is prepared using Resin 3 in the same manner as in Example 1. The obtained liquid dispersion is found to have a volume average particle diameter of 181 nm and a solid content concentration of 42.5%. Also, the residual MEK amount and the residual IPA amount each is found to be 70 ppm.

<Preparation of Toner Particle 3>

A toner is produced in the same manner as in Example 1 by using the colorant particle liquid dispersion and releasing agent particle liquid dispersion prepared in Example 1 and using Resin Particle Liquid Dispersion 3 prepared above. The toner particle after drying is found to have a volume average particle diameter of 6.0 μm and a volume average particle diameter distribution of 1.23. Also, the weight average molecular weight of the dried toner shows a peak value Mtp of 9,220, revealing that the peak retention percentage is 100%.

<Production and Evaluation of Electrostatic Image Developer 3>

Electrostatic Image Developer 3 is produced using Toner Particle 3 in the same manner as in Example 1. Then, this developer is evaluated in the same manner as in Example 1 for the amount of triboelectric charge, image quality, toner breakage and adherence to paper. As a result, the amount of triboelectric charge is −48 μC/g, revealing good electric chargeability. Also, no problem is observed in all of evaluations of image quality, toner breakage and adherence to paper, and excellent toner characteristics are exhibited.

Example 4

<Production of Resin 4>

Polymerization of Resin 4 is performed according to the following monomer formulation in the same manner as in Example 1.

(Polyvalent Carboxylic Acid Monomer)

Dimethyl terephthalate: 582.6 parts by weight (30 mol %)

Dodecenylsuccinic anhydride: 268.4 parts by weight (10 mol %)

(Polyhydric Alcohol Component)

Bisphenol A-ethylene oxide 2 mol adduct: 949.2 parts by weight (30 mol %)

Bisphenol A-propylene oxide 2 mol adduct: 688.8 parts by weight (20 mol %)

These polyvalent carboxylic acid monomer and polyhydric alcohol component are subjected to a reaction at 150° C. in the same manner as in Example 1 and after adding 216.2 parts by weight (10 mol %) of 1,4-phenylene bisoxazoline, the reaction is continued at 180° C. When the weight average molecular weight by GPC molecular weight measurement reaches 21,100, the reaction is terminated. The resin taken out is found to have a weight average molecular weight Mw of 21,130, a peak molecular weight Mrp of 9,520, a number average molecular weight of 4,150, and a Tg of 61.5° C.

Incidentally, from the IR measurement of the produced resin performed in the same manner as in Example 1, an asymmetric stretch peak of an amide group is confirmed at 1,572 $cm^{-1}$ and 1,522 $cm^{-1}$.

<Preparation of Resin Particle Liquid Dispersion 4>

Resin Particle Liquid Dispersion 4 is prepared using Resin 4 in a pressure reaction apparatus with charge ports for ion-exchanged water and nitrogen gas.

The amounts charged are the same as in Example 1, but in place of MEK and IPA used in Example 1, a mixture prepared by mixing 27.8 parts by weight of styrene monomer and 7.0 parts by weight of butyl acrylate as addition-polymerizable monomers and mixing 0.35 parts by weight of dodecanethiol as a molecular weight adjusting agent is added to Resin 4. Furthermore, 3 parts by weight of 25% aqueous ammonia is added and after applying a pressure to 1.0 MPa with a nitrogen gas, the system is heated at 90° C. and thoroughly mixed. Thereafter, 590 parts by weight of ion-exchanged water is added at 90° C. to emulsify the resin.

After the completion of emulsification by the addition of ion-exchanged water, the temperature is lowered to 70° C., a solution prepared by dissolving 0.3 parts by weight of ammonium persulfate in 3 parts by weight of water is further added, and addition polymerization is performed by continuing heating at 70° C. for 6 hours. The liquid dispersion obtained after cooling is found to have a volume average particle diameter of 175 nm and a solid content concentration of 42.4%.

<Preparation of Toner Particle 4>

A toner is produced in the same manner as in Example 1 by using the colorant particle liquid dispersion and releasing agent particle liquid dispersion prepared in Example 1 and using Resin Particle Liquid Dispersion 4 prepared above. The toner particle after drying is found to have a volume average particle diameter of 6.3 μm and a volume average particle diameter distribution of 1.23. Also, the weight average molecular weight of the dried toner shows a peak value Mtp of 9,520, revealing that the peak retention percentage is 100%.

<Production and Evaluation of Electrostatic Image Developer 4>

Electrostatic Image Developer 4 is produced using Toner Particle 4 in the same manner as in Example 1.

Then, this developer is evaluated in the same manner as in Example 1 for the amount of triboelectric charge, image quality, toner breakage and adherence to paper. As a result, the amount of triboelectric charge is −49 μC/g, revealing good electric chargeability. Also, no problem is observed in all of evaluations of image quality, toner breakage and adherence to paper, and excellent toner characteristics are exhibited.

Example 5

<Production of Resin 5>

Polymerization of Resin 5 is performed according to the following monomer formulation in the same manner as in Example 1.

(Polyvalent Carboxylic Acid Monomer)

Dimethyl terephthalate: 679.7 parts by weight (35 mol %)

Dodecenylsuccinic anhydride: 134.2 parts by weight (5 mol %)

(Polyhydric Alcohol Component)

Bisphenol A-ethylene oxide 2 mol adduct: 949.2 parts by weight (30 mol %)

Bisphenol A-propylene oxide 2 mol adduct: 688.8 parts by weight (20 mol %)

These polyvalent carboxylic acid monomer and polyhydric alcohol component are subjected to a reaction at 150° C. in the same manner as in Example 4 and after adding 216.2 parts by weight (10 mol %) of 1,4-phenylene bisoxazoline, the reaction is continued at 180° C. When the weight average molecular weight by GPC molecular weight measurement reaches 24,000, the reaction is terminated. The resin taken out is found to have a weight average molecular weight Mw of 24,230, a peak molecular weight Mrp of 9,650, a number average molecular weight of 4,350, and a Tg of 60.5° C.

<Preparation of Resin Particle Liquid Dispersion 5>

Resin Particle Liquid Dispersion 5 is prepared using Resin 5 in a pressure reaction apparatus in the same manner as in Example 4.

The amounts charged are the same as in Example 4, but a mixture prepared by mixing 137.1 parts by weight of styrene monomer and 34.3 parts by weight of butyl acrylate as addition-polymerizable monomers and mixing 1.7 parts by weight of dodecanethiol as a molecular weight adjusting agent is added to Resin 5. Furthermore, 3 parts by weight of 25% aqueous ammonia is added and after applying a pressure to 1.0 MPa with a nitrogen gas, the system is heated at 80° C. and thoroughly mixed. Thereafter, 773 parts by weight of ion-exchanged water is added at 80° C. to emulsify the resin.

After the completion of emulsification by the addition of ion-exchanged water, the temperature is lowered to 70° C., a solution prepared by dissolving 1.7 parts by weight of ammonium persulfate in 5 parts by weight of water is further added, and addition polymerization is performed by continuing heating at 70° C. for 6 hours. The liquid dispersion obtained after cooling is found to have a volume average particle diameter of 170 nm and a solid content concentration of 42.5%.

<Preparation of Toner Particle 5>

A toner is produced in the same manner as in Example 1 by using the colorant particle liquid dispersion and releasing agent particle liquid dispersion prepared in Example 1 and using Resin Particle Liquid Dispersion 5 prepared above. The toner particle after drying is found to have a volume average particle diameter of 6.0 μm and a volume average particle diameter distribution of 1.21. Also, the weight average molecular weight of the dried toner shows a peak value Mtp of 9,650, revealing that the peak retention percentage is 100%.

<Production and Evaluation of Electrostatic Image Developer 5>

Electrostatic Image Developer 5 is produced using Toner Particle 5 in the same manner as in Example 1.

Then, this developer is evaluated in the same manner as in Example 1 for the amount of triboelectric charge, image quality, toner breakage and adherence to paper. As a result, the amount of triboelectric charge is −47 μC/g, revealing good electric chargeability. Also, no problem is observed in all of evaluations of toner breakage and adherence to paper. As for the image quality, slight nonuniformity considered to result from phase separation between polycondensed resin and addition-polymerized resin is observed, but the degree of nonuniformity is in a level not causing any problem in practice.

Comparative Example 1

<Production of Resin 6>

As Comparative Example, polymerization of a polyester resin not containing a carbonate bond, an amide bond and a dodecenylsuccinic acid unit is performed according to the following monomer formulation in the same manner as in Example 1 to polymerize Resin 6.

(Polyvalent Carboxylic Acid Monomer)

Dimethyl terephthalate: 776.8 parts by weight (40 mol %)

Fumaric acid: 116.0 parts by weight (10 mol %)

(Polyhydric Alcohol Component)

Bisphenol A-ethylene oxide 2 mol adduct: 949.2 parts by weight (30 mol %)

Bisphenol A-propylene oxide 2 mol adduct: 688.8 parts by weight (20 mol %)

These polyvalent carboxylic acid monomer and polyhydric alcohol component are subjected to a reaction at 150° C. in the same manner as in Example 1 and after elevating the temperature to 180° C., the reaction is continued. When the weight average molecular weight by GPC molecular weight measurement reaches 20,000, the reaction is terminated. The resin taken out is found to have a weight average molecular weight Mw of 20,130, a peak molecular weight Mrp of 9,050, a number average molecular weight of 4,150, and a Tg of 61.5° C.

<Preparation of Resin Particle Liquid Dispersion 6>

Resin Particle Liquid Dispersion 6 is prepared using Resin 6 in the same manner as in Example 1. In the obtained resin particle liquid dispersion, the volume average particle diameter is 188 nm, the solid content concentration is 42.5%, and the residual MEK amount and residual IPA amount each is 90 ppm.

<Preparation of Toner Particle 6>

A toner is produced in the same manner as in Example 1 by using the colorant particle liquid dispersion and releasing agent particle liquid dispersion prepared in Example 1 and using Resin Particle Liquid Dispersion 6 prepared above. The toner particle after drying is found to have a volume average particle diameter of 6.3 μm and a volume average particle diameter distribution of 1.24. Also, the weight average molecular weight of the dried toner shows a peak value Mtp of 8,100. Thus, the peak retention percentage is 89.5% and it is revealed that the resin is hydrolyzed during the toner production and the molecular weight peak is decreased.

<Production and Evaluation of Electrostatic Image Developer 6>

Electrostatic Image Developer 6 is produced using Toner Particle 6 in the same manner as in Example 1.

Then, this developer is evaluated in the same manner as in Example 1 for the amount of triboelectric charge, image quality, toner breakage and adherence to paper. As a result, the amount of triboelectric charge is −18 μC/g due to the hydrolysis of the resin and this low electric chargeability is practically a problem. Also, as for the image quality, scattering of the toner is observed to incur a practical problem in the image quality. Furthermore, toner breakage in the developing machine and in turn, an aggregate of partially exposed releasing agent components are observed, and this a problem. In the evaluation of adherence to paper, interfacial separation from paper is observed in all cases and the adherence to paper has a practically serious problem.

Comparative Example 2

<Production of Resin 7>

As Comparative Example, polymerization of a polyester resin not containing a carbonate bond and an amide bond is performed according to the following monomer formulation in the same manner as in Example 1 to polymerize Resin 7.

(Polyvalent Carboxylic Acid Monomer)

Dimethyl terephthalate: 582.6 parts by weight (30 mol %)

Fumaric acid: 116.0 parts by weight (10 mol %)

Dodecenylsuccinic anhydride: 268.4 parts by weight (10 mol %)

(Polyhydric Alcohol Component)

Bisphenol A-ethylene oxide 2 mol adduct: 949.2 parts by weight (30 mol %)

Bisphenol A-propylene oxide 2 mol adduct: 688.8 parts by weight (20 mol %)

These polyvalent carboxylic acid monomer and polyhydric alcohol component are subjected to a reaction at 150° C. in the same manner as in Example 1 and after elevating the temperature to 180° C., the reaction is continued. When the weight average molecular weight by GPC molecular weight measurement reaches 21,000, the reaction is terminated. The resin taken out is found to have a weight average molecular weight Mw of 21,140, a peak molecular weight Mrp of 9,130, a number average molecular weight of 4,050, and a Tg of 60.3° C.

<Preparation of Resin Particle Liquid Dispersion 7>

Resin Particle Liquid Dispersion 7 is prepared using an addition-polymerization monomer and Resin 7 in the same manner as in Example 5. The obtained resin particle liquid dispersion is found to have a volume average particle diameter of 181 nm and a solid content concentration of 42.5%.

<Preparation of Toner Particle 7>

A toner is produced in the same manner as in Example 1 by using the colorant particle liquid dispersion and releasing agent particle liquid dispersion prepared in Example 1 and using Resin Particle Liquid Dispersion 7 prepared above. The toner particle after drying is found to have a volume average particle diameter of 5.9 μm and a volume average particle diameter distribution of 1.22. Also, the weight average molecular weight of the dried toner shows a peak value Mtp of 8,050. Thus, the peak retention percentage is 88.2% and it is revealed that the resin is hydrolyzed during the toner production and the molecular weight peak is decreased.

<Production and Evaluation of Electrostatic Image Developer 7>

Electrostatic Image Developer 7 is produced using Toner Particle 7 in the same manner as in Example 1.

Then, this developer is evaluated in the same manner as in Example 1 for the amount of triboelectric charge, image quality, toner breakage and adherence to paper. As a result, the amount of triboelectric charge is −19 μC/g and this low electric chargeability is a level causing a problem in practice. As for the image quality, scattering of the toner is observed to incur a problem in the image quality. This is considered to occur because toner breakage in the developing machine and in turn, an aggregate of partially exposed releasing agent components are generated. In the evaluation of adherence to paper, slight interfacial separation from paper is observed, which is, however, in a level not causing a problem in practice.

The results of Examples and Comparative Examples are shown together in Table 1.

As seen from these results, by using a polyester carbonate resin or polyester amide resin containing from 0.5 to 30 mol % of a dodecenylsuccinic acid unit, both the toner productivity (hydrolyzability) and the electrophotographic property such as electric charging can be satisfied to a high level.

TABLE 1

| | | | Example | | | | | Comparative Example | |
|---|---|---|---|---|---|---|---|---|---|
| | | | 1 | 2 | 3 | 4 | 5 | 1 | 2 |
| Resin Component Construction | Carboxylic acid monomer | Dimethyl terephthalate (mol %) | 40 | 20 | 30 | 30 | 35 | 40 | 30 |
| | | Fumaric acid (mol %) | 9.5 | — | — | — | — | 10 | 10 |
| | | Dodecenylsuccinic anhydride (mol %) | 0.5 | 30 | 20 | 10 | 5 | — | 10 |
| | Alcohol monomer | Bisphenol A-ethylene oxide 2 mol adduct (mol %) | 30 | 25 | 20 | 30 | 30 | 30 | 30 |
| | | Bisphenol A-propylene oxide 2 mol adduct (mol %) | 15 | 15 | 15 | 20 | 20 | 20 | 20 |
| | Other polycondensation components | Carbonylbis (1-caprolactam) (mol %) | 5 | 10 | 15 | — | — | — | — |
| | | 1,4-Phenylene bisoxazoline (mol %) | — | — | — | 10 | 10 | — | — |
| | Addition polymerization component | Amount of addition-polymerizable monomer blended (wt % in resin containing the monomer) | — | — | — | 8 | 30 | — | 30 |
| Evaluation Items | Resin and toner characteristics | Peak molecular weight Mrp of resin molecular weight distribution | 9.150 | 9.320 | 9.220 | 9.520 | 9.650 | 9.050 | 9.130 |
| | | Peak molecular weight Mtp of toner molecular weight distribution | 9.150 | 9.320 | 9.220 | 9.520 | 9.650 | 8.100 | 8.050 |
| | | Molecular weight peak retention percentage (%) {(Mtp/Mrp) × 100} | 100 | 100 | 100 | 100 | 100 | 89.5 | 88.2 |
| | Electrophotographic characteristics of toner | Electric charging property of toner | A | A | A | A | A | C | C |
| | | Toner breakage in developing machine | A | A | A | A | A | C | C |
| | | Adherence to paper | A | A | A | A | A | C | B |
| | | Uniformity of image quality | A | A | A | A | B | C | C |

In Table 1, the ratings of electric charging property of toner, toner breakage in developing machine, adherence to paper and uniformity of image quality are based on the following criteria.

A: Level causing no problem in practice.

B: Level causing no problem in practice despite occurrence of a slight problem.

C: Level causing a problem in practice.

What is claimed is:

1. An electrostatic image developing toner comprising:

a binder resin that comprises at least a polyester carbonate resin, the polyester carbonate resin containing a dodecenylsuccinic acid unit in an mount from about 0.5 mol % to about 30 mol % as a monomer unit; and a colorant.

2. The electrostatic image developing toner according to claim 1, wherein the polyester carbonate resin has a weight average molecular weight of from about 3,000 to about 60,000.

3. The electrostatic image developing toner according to claim 1, wherein the polyester carbonate resin is a crystalline resin having a melting temperature Tm of from about 50° C. to about 120° C.

4. The electrostatic image developing toner according to claim 1, wherein the polyester carbonate resin is a noncrystalline resin having a glass transition temperature Tg of from about 40° C. to about 80° C.

5. The electrostatic image developing toner according to claim 1, wherein the binder resin further comprises an addition polymerization-type resin in an amount of from about 5 wt% to about 50 wt %.

6. The electrostatic image developing toner according to claim 5, wherein the addition polymerization-type resin has a weight average molecular weight of from about 5,000 to about 200,000.

7. The electrostatic image developing toner according to claim 1, wherein the colorant is contained in an amount of from about 0.1 part by weight to about 20 parts by weight per 100 parts by weight of the electrostatic image developing toner.

8. The electrostatic image developing toner according to claim 1, which has a volume average particle diameter $D_{50v}$ of from about 2 μm to about 10 μm.

9. The electrostatic image developing toner according to claim 1, which has a number average particle size distribution index GSDp of about 1.40 or less.

10. The electrostatic image developing toner according to claim 1, which has a shape factor SF1 of from about 110 to about 145.

11. An electrostatic image developer comprising:

the electrostatic image developing toner of claim 1; and a carrier.

12. An image forming method comprising:

forming an electrostatic latent image on a surface of a latent image carrier;

developing the electrostatic latent image formed on the surface of the latent image carrier with the electrostatic image developer of claim 11 to form a toner image;

transferring the toner image formed on the surface of the latent image carrier onto a surface of a transfer member; and heat-fixing the toner image transferred onto the surface of the transfer member.

13. A production method of the electrostatic image developing toner of claim 1, the method comprising:

synthesizing a polyester carbonate resin having, as a monomer unit, from about 0.5 mol % to about 30 mol % of a dodecenylsuccinic acid unit, dispersing a resin containing the polyester carbonate resin in an aqueous medium to obtain a resin particle liquid dispersion, aggregating the resin particles in a liquid dispersion containing at least the resin particle liquid dispersion and a colorant to obtain an aggregate particle, and fusing together the aggregate particles by heating.

14. The production method according to claim 13, wherein the polyester carbonate resin is a polycondensed resin obtained by polycondensation in the presence of a polycondensation catalyst.

15. The production method according to claim 14, wherein the polycondensation catalyst is a sulfur acid.

16. The production method according to claim 14, wherein a used amount of the sulfur acid is from about 0.05 wt % to about 20 wt % based on a total weight of polycondensation components.

* * * * *